US007525440B2

(12) United States Patent
Carreras et al.

(10) Patent No.: US 7,525,440 B2
(45) Date of Patent: Apr. 28, 2009

(54) PERSON MONITORING

(75) Inventors: Ricardo F. Carreras, Southborough, MA (US); Glenn Gomes-Casseres, Framingham, MA (US); Marc Hertzberg, Sudbury, MA (US); Daniel D. Najemy, Grafton, MA (US); Ray Wakeland, Marlborough, MA (US)

(73) Assignee: Bose Corporation, Framingham, MA (US)

( * ) Notice: Subject to any disclaimer, the term of this patent is extended or adjusted under 35 U.S.C. 154(b) by 666 days.

(21) Appl. No.: 11/142,749

(22) Filed: Jun. 1, 2005

(65) Prior Publication Data

US 2006/0273914 A1 Dec. 7, 2006

(51) Int. Cl.

| | |
|---|---|
| ***G08B 23/00*** | (2006.01) |
| ***G08B 25/08*** | (2006.01) |
| ***H04R 29/00*** | (2006.01) |
| ***G10K 11/00*** | (2006.01) |
| ***G08B 3/02*** | (2006.01) |

(52) U.S. Cl. ..... 340/573.1; 340/692; 381/57; 181/18; 181/19; 181/139

(58) Field of Classification Search ..... 340/500, 340/501, 573.1, 692; 381/26, 56, 57, 99–103; 181/18, 19, 139

See application file for complete search history.

(56) References Cited

U.S. PATENT DOCUMENTS

| | | | | |
|---|---|---|---|---|
| 5,109,416 | A | 4/1992 | Croft | |
| 5,492,129 | A * | 2/1996 | Greenberger | 600/528 |
| 5,933,495 | A | 8/1999 | Oh | |
| 6,091,329 | A | 7/2000 | Newman | |
| 6,434,110 | B1 * | 8/2002 | Hemkumar | 370/201 |
| 6,462,664 | B1 | 10/2002 | Cuijpers et al. | |
| 6,483,532 | B1 | 11/2002 | Girod | |
| 6,759,961 | B2 | 7/2004 | Fitzgerald et al. | |
| 7,382,233 | B2 * | 6/2008 | Steinetz et al. | 340/392.1 |
| 2003/0005462 | A1 | 1/2003 | Broadus et al. | |
| 2003/0072458 | A1 * | 4/2003 | Halleck et al. | 381/67 |
| 2003/0083024 | A1 | 5/2003 | Richenstein et al. | |
| 2003/0163827 | A1 * | 8/2003 | Purpura | 725/105 |
| 2004/0125962 | A1 * | 7/2004 | Christoph | 381/59 |
| 2004/0257233 | A1 * | 12/2004 | Proebsting | 340/573.1 |
| 2005/0185799 | A1 * | 8/2005 | Bertram | 381/67 |
| 2005/0245839 | A1 * | 11/2005 | Stivoric et al. | 600/549 |
| 2006/0198533 | A1 * | 9/2006 | Wang et al. | 381/67 |
| 2006/0219473 | A1 * | 10/2006 | Boland et al. | 181/139 |
| 2007/0086927 | A1 * | 4/2007 | Natarajan et al. | 422/102 |

(Continued)

FOREIGN PATENT DOCUMENTS

| | | |
|---|---|---|
| EP | 0 948 237 | 10/1999 |

(Continued)

OTHER PUBLICATIONS

Safety 1st Home Connection Monitor System 08038 User Guide, Copyright 2004, Jan. 2004, pp. 1-9.

*Primary Examiner*—Toan N Pham
*Assistant Examiner*—Jennifer Mehmood

(57) ABSTRACT

A person monitoring system, such as a baby monitor a monitored unit including a microphone for transducing radiated sound waves and sound waves emanating from the person to a received audio signal and circuitry for removing from the received audio signal a portion of the received audio signal corresponding to the radiated sound waves to provide an audio signal corresponding to the sound waves emanating from the person.

44 Claims, 20 Drawing Sheets

U.S. PATENT DOCUMENTS

2007/0198128 A1 * 8/2007 Ziegler et al. ..... 700/245

FOREIGN PATENT DOCUMENTS

| | | | |
|---|---|---|---|
| EP | 1 372 355 | A1 | 12/2003 |
| GB | 2 322 952 | A | 9/1998 |
| GB | 2 346 042 | A | 7/2000 |
| GB | 2 391 673 | A1 | 2/2004 |
| WO | WO01/29984 | A1 | 4/2001 |
| WO | WO03/030121 | A1 | 4/2003 |
| WO | WO03/058830 | A1 | 7/2003 |
| WO | WO 2004/015643 | A1 | 2/2004 |
| WO | WO 2004/069319 | A1 | 8/2004 |
| WO | WO 2006/043193 | | 4/2006 |

* cited by examiner

PERSON MONITORING

BACKGROUND

This specification relates to the field of person monitoring systems, such as baby monitors, and more particularly to person monitoring systems which can play music to the monitored person.

SUMMARY

In one aspect of the invention a person monitoring system may include a monitored unit including a microphone for transducing radiated sound waves and sound waves emanating from the person to a received audio signal and circuitry for removing from the received audio signal a portion of the received audio signal corresponding to the radiated sound waves to provide a first processed received audio signal corresponding to the sound waves emanating from the person.

The monitored unit may include an audio signal source for providing a source audio signal and a loudspeaker for transducing the source audio signal to provide the radiated sound waves. The monitored unit may further include a unitary housing for the audio signal source, the microphone, and the circuitry. The monitored unit may include transmitting circuitry to wirelessly broadcast the first processed received audio signal to provide a broadcast processed received audio signal. The monitoring system may further include a monitoring unit. The monitoring unit may include receiving circuitry for receiving the broadcast processed received audio signal and a transducer for transducing the broadcast processed received audio signal to sound waves. The microphone may be constructed and arranged to remotely transduce the radiated sound waves and the sound waves emanating from the person to provide the received audio signal and to transmit the received audio signal to the removing circuitry. The microphone may be constructed and arranged to transmit wirelessly the received audio signal. The monitored unit may further include a first housing for the microphone and the removing circuitry and a second housing, separate from the first housing for the audio signal source and the loudspeaker.

The monitored unit may include transmitting circuitry for transmitting the first processed received audio signal to a monitoring device. The monitoring device may be a network for providing the first processed received audio signal to devices accessible by the network.

The monitored unit may include transmitting circuitry to transmit the first processed received audio signal. The monitoring system may include a first monitoring unit including receiving circuitry for receiving the transmitted first processed received audio signal from the monitored unit. The monitoring system may include a second monitoring unit that may include receiving circuitry for receiving the first transmitted processed received audio signal from the monitored unit. The transmitting circuitry may include circuitry to wirelessly broadcast the first processed received audio signal to provide a broadcast processed received audio signal. The system may include a monitoring unit. The monitoring unit may include receiving circuitry for wirelessly receiving the broadcast processed received audio signal. The monitoring unit may include a transducer for transducing the broadcast processed received audio signal to sound waves. The system may include a monitoring unit may include circuitry for receiving the first transmitted processed received audio signal and for providing the first processed received audio signal to an audio signal network, to transmit the first processed received audio signal to devices coupled to the audio signal network. The person monitoring system may include a second monitored unit that may include a second microphone for transducing second radiated sound waves and second sound waves emanating from a second person to a second received audio signal, second circuitry for removing from the second received audio signal a portion of the second received audio signal corresponding to the second radiated sound waves to provide a second processed received audio signal corresponding to the second sound waves emanating from the second person, and second transmitting circuitry to transmit the second processed received audio signal. The system may include a monitoring unit that may include receiving circuitry for receiving the first broadcast processed received audio signal the second broadcast processed received audio signal and circuitry for determining which of the first processed received audio signal and the second processed received audio signal to monitor. The system may include a second monitoring unit. The second monitoring unit may include second receiving circuitry for receiving broadcast processed received audio signals and second circuitry for determining which of the first processed received audio signal and the second processed received audio signal to monitor. The determining circuitry may include circuitry for comparing the amplitude of the first processed received audio signal and the amplitude of the second processed received audio signal; and circuitry for selecting one of the first processed received audio signal and the second processed received audio signal corresponding to the processed received audio signal with the greater amplitude.

In another aspect of the invention, a method for operating a person monitoring system may include providing a source audio signal and transducing the source audio signal to radiated sound waves. The transducing may include radiating sound waves from a loudspeaker. The method may further include transducing sound waves including the radiated sound waves and sound waves emanating from a person to a received audio signal, including receiving the sound waves by a microphone. The method may further include removing a portion of the received audio signal corresponding to the radiated sound waves to provide a processed audio signal corresponding substantially to the sound waves emanating from the person. The transducing sound waves may include transducing sound waves from a noise source, and may include removing a portion of the received audio signal corresponding to the sound waves from the noise source. The removing a portion of the received audio signal corresponding to the sound waves from the noise source may include filtering the received audio signal with an adaptive filter. The filtering the received audio signal with an adaptive filter may include transducing, separate from the transducing sound radiated sound waves, sound waves emanating from the person and sound waves from the noise source by a microphone substantially closer to the noise source than to other sources of sound waves to provide transduced sound waves, and providing the transduced sound waves to the adaptive filter.

The removing may include band pass filtering the received audio signal. The band pass filtering may include filtering the received audio signal with a filter with a pass band substantially corresponding with the speech audio band. The band pass filtering may include filtering the received audio signal with a filter with break points of approximately 300 Hz and 3 kHz.

The removing may include filtering the received audio signal with an adaptive filter. The method may include providing the source audio signal to the adaptive filter. The transducing the source audio signal may include directionally radiating the sound waves so that a direction toward the microphone may be a low radiation direction. The transducing the sound waves may include directionally receiving the sound waves so that a direction from the loudspeaker may be a low response direction. The directionally receiving the sound waves may include a first receiving by a first substantially omni-directional microphone to provide a first omni-directionally received audio signal; a second receiving by a second substantially omni-directional microphone to provide a second omni-directionally received audio signal; adjusting the phase of the first omni-directionally received audio signal and the second omni-directionally received audio signal to provide phase-adjusted first and second received omni-directionally received audio signals; and combining the first and the second omni-directionally received audio signals. The directionally radiating the sound waves may include low pass filtering the source audio signal to provide a low pass filtered audio signal; high pass filtering the source audio signal to provide a high pass filtered audio signal; a first combining of the high pass filtered audio signal and the low pass filtered audio signal to provide a first combined audio signal having a high frequency spectral band and a low frequency spectral band; a differential second combining of the high pass filtered audio signal and the low pass audio signal to provide a second combined audio signal having a high frequency spectral band and a low frequency spectral band; radiating the first combined audio signal and the second combined audio signal so that sound waves corresponding to the high frequency spectral band of the first combined audio signal high are radiated out of phase with the high frequency spectral band portion of the second combined audio signal. The source audio signal may have a high frequency portion and a low frequency portion. The providing the source audio signal may include providing a first track and a second track of the source audio signal wherein the first track and the second track each comprises a high frequency portion and a low frequency portion. The providing the first track and the second track may include processing the source audio signal high frequency portion so that high frequency portion of the first track high may be out of phase with the high frequency portion of the second track.

The method may include transmitting the processed audio signal to a location remote from the person to provide a received processed audio signal. The method may include transducing the received processed audio signal to sound waves corresponding to the received processed audio signal. The method may include, in the absence of sound waves emanating from the person, transmitting an audio signal representing white noise.

The receiving the sound waves by a microphone may include receiving the sound waves by a microphone that may be physically close to the person and wherein the microphone may be physically distant from circuitry for performing the removing.

The method may include transmitting the processed audio signal to an audio network.

The removing may include radiating sound waves corresponding to an audio signal representing an audio test pattern; transducing the sound waves corresponding to the audio signal representing the audio test pattern to a received audio test pattern audio signal; and comparing the received audio test pattern audio signal with the audio signal representing the audio test pattern to develop a transfer function representing the effect of the environment on the radiated sound waves corresponding to the audio signal representing the audio test pattern to a received audio test pattern audio signal.

In another aspect of the invention, a person monitoring system may include a first monitored unit for transducing to a first audio signal sound waves emanating from a first person and for transmitting the first audio signal; a second monitored unit for transducing to a second audio signal sound waves emanating from a second person and for transmitting the second audio signal; a monitoring unit for receiving the first audio signal and the second audio signal. The monitoring unit may include circuitry for comparing the amplitude of the first audio signal and the amplitude of the second audio signal; and circuitry for selecting one of the first audio signal and the second audio signal corresponding to the audio signal with the greater amplitude.

In yet another aspect of the invention, a method for operating a person monitoring system that includes a first monitoring unit and a first monitored unit, may include exchanging, by the first monitoring unit and the first monitored unit device identifiers; recording, by the first monitoring unit the device identifier of the first monitored unit; and recording, by the first monitored unit, the device identifier of the first monitoring unit.

The exchanging, the recording by the first monitoring device, and the recording by the first monitoring device are initiated by a manufacturer of the person monitoring system. The exchanging, the recording by the first monitoring device, and the recording by the first monitoring device are initiated by a user of the person monitoring system.

The identifiers may be associated with IEEE 802.3 compliant MAC identifiers.

The monitoring system may include a second monitored unit and the method may include exchanging, by the first monitoring unit and the second monitored unit device identifiers; recording, by the first monitoring unit the device identifier of the second monitored unit; and recording, by the second monitored unit, the device identifier of the first monitoring unit. The exchanging by the first monitoring unit and the second monitored unit device identifiers, the recording by the first monitoring unit the device identifier of the second monitored unit, and the recording by the second monitored unit, the device identifier of the first monitoring unit may be initiated by a user of the person monitoring system. The exchanging by the first monitoring unit and the first monitored unit device identifiers, the recording by the first monitoring unit the device identifier of the first monitored unit, and the recording by the first monitored unit the device identifier of the first monitoring unit may be initiated by a manufacturer of the person monitoring system. The monitoring system may include a second monitoring unit, and the method may include: exchanging, by the second monitoring unit and the second monitored unit device identifiers; recording, by the second monitoring unit the device identifier of the second monitored unit; and recording, by the second monitored unit, the device identifier of the second monitoring unit. The monitoring system may include a second monitoring unit, and the method may include exchanging, by the second monitoring unit and the first monitored unit device identifiers; recording, by the second monitoring unit the device identifier of the first monitored unit; and recording, by the first monitored unit, the device identifier of the second monitoring unit.

Other features, objects, and advantages will become apparent from the following detailed description, when read in connection with the following drawing, in which:

DETAILED DESCRIPTION

Figure 1:
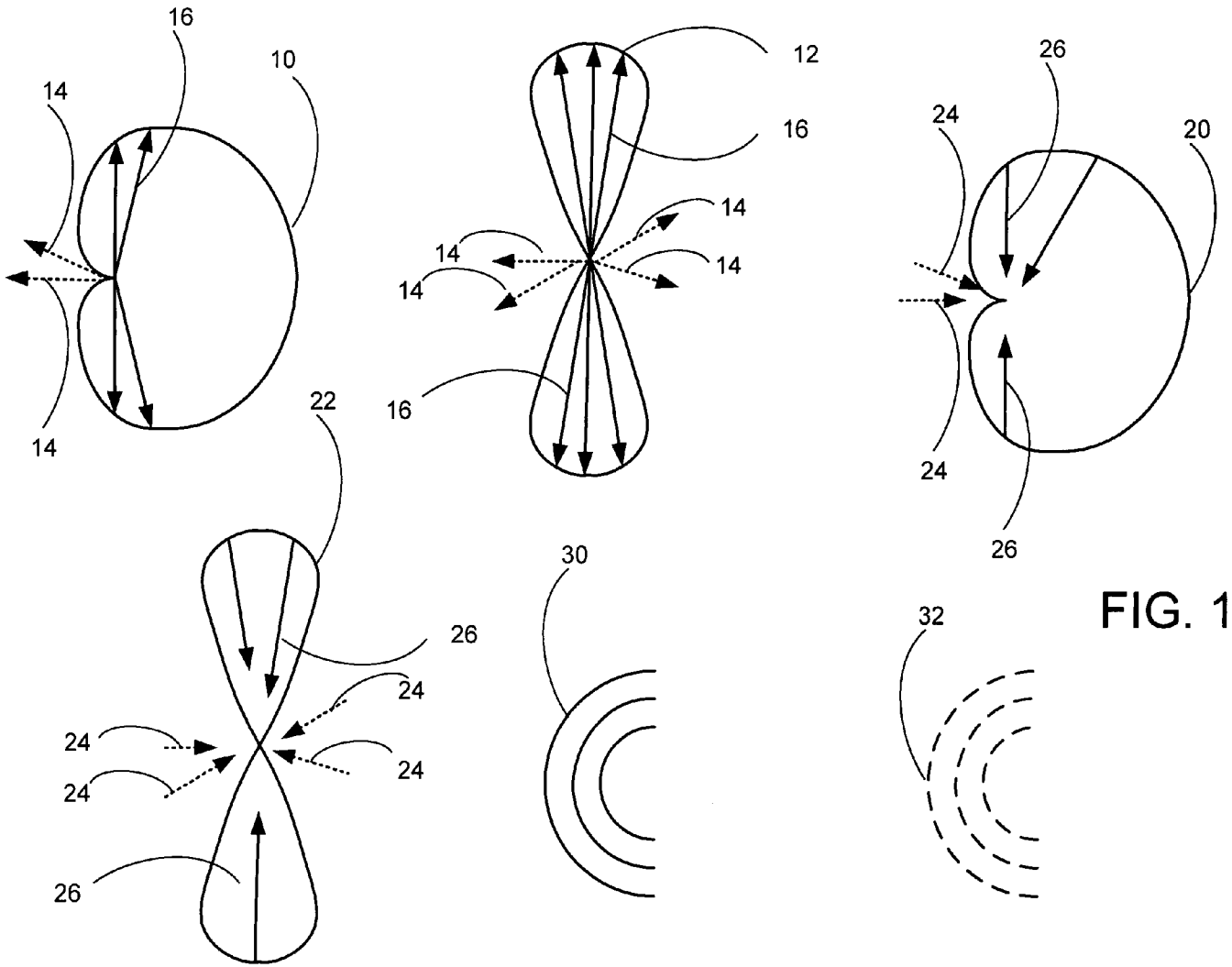
FIG. 1 explains some conventions used in the specification.

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Some of the processing operations may be expressed in terms of the calculation and application of coefficients. The equivalent of calculating and applying coefficients can be performed by other analog or digital signal processing techniques and are included within the scope of this patent application. Unless otherwise indicated, audio signals may be encoded in either digital or analog form and may be processed in either analog or digital form, with appropriate processors and digital-to-analog and analog-to-digital converters employed as needed.

The figures below include systems which include directional loudspeakers, directional microphones, and the radiation of acoustic and electromagnetic energy. FIG. 1 shows some conventions that will be used in the drawing. Polar plot 10 represents the radiation directional characteristics of a directional loudspeaker, in this case a so-called "cardioid" pattern. Polar plot 12 represents the radiation directional characteristics of a second type of directional loudspeaker, in this case a dipole pattern. Polar plots 10 and 12 indicate a directional radiation pattern. Low radiation directions are indicated by outward directed dotted line indicators 14. Low radiation directions are directions in which the sound pressure level (SPL) from the directional loudspeaker is more than 6 dB less than (i.e. −6 dB), preferably between 6 and 10 dB less than (i.e. −6 dB to −10 dB), and ideally more than 20 dB less than (i.e. −20 dB) the maximum SPL in any direction at points equally spaced from directional loudspeaker. Low radiation directions are preferably, but are not necessarily, "null directions," Null directions are directions in which the local radiation is at a local minimum relative to other points equally spaced from the acoustic energy source. High radiation directions are indicated by outward directed solid line indicators 16. High radiation directions are directions in which the SPL from the directional loudspeaker is less than 6 dB less than (i.e. −6 dB), preferably between 6 dB and 4 dB less than (i.e. −6 dB to −4 dB), and ideally less than 4 dB less than (i.e. −4 dB to −0 dB) the maximum SPL in any direction at points of equivalent distance from the directional loudspeaker. One popular type of directional loudspeaker is a directional acoustic array. Information on directional acoustic arrays can be found in Harry F. Olson, "*Gradient Loudspeakers," J. of the Audio Engineering Society*, March 1973, Volume 21, Number 2, in U.S. Pat. No. 5,587,048, and in U.S. Pat. No. 5,809,153.

Directional microphones are microphones which are more responsive to sound waves from some directions than from others. Polar plots 20 and 22 indicate a directional response pattern. Low response directions are indicated by inward directed dotted line indicators 24. Low response directions are directions in which the response of the directional microphone is more than 6 dB less than (i.e. −6 dB), preferably between 6 and 10 dB less than (i.e. −6 dB to −10 dB), and ideally more than 20 dB less than (i.e. −20 dB), the maximum SPL in any direction at points equally spaced from the directional microphone. Low response directions are preferably, but are not necessarily, "null directions," Null directions are directions in which the microphone response is at a local minimum relative to other points equally spaced from the microphone. High response directions are indicated by inward directed solid line indicators 26. High response directions are directions in which the response of the directional microphone is less than 6 dB less than (i.e. −6 dB), preferably between 6 dB and 4 dB less than (i.e. −6 dB to −4 dB), and ideally less than 4 dB less than (i.e. −4 dB to −0 dB) the maximum SPL in any direction at points of equivalent distance from the directional microphone.

Solid line radiation indicators 30 indicate the radiation or reception of acoustic energy of an associated sound source. Radiation indicators 30 do not indicate the directivity pattern of the acoustic radiation; relevant characteristics of the acoustic radiation pattern are indicated by indicators 14, 16, 24, and 26 and are described in the text. Dashed line radiation indicators 32 indicate the radiation or reception of electromagnetic radiation.

Figure 2:
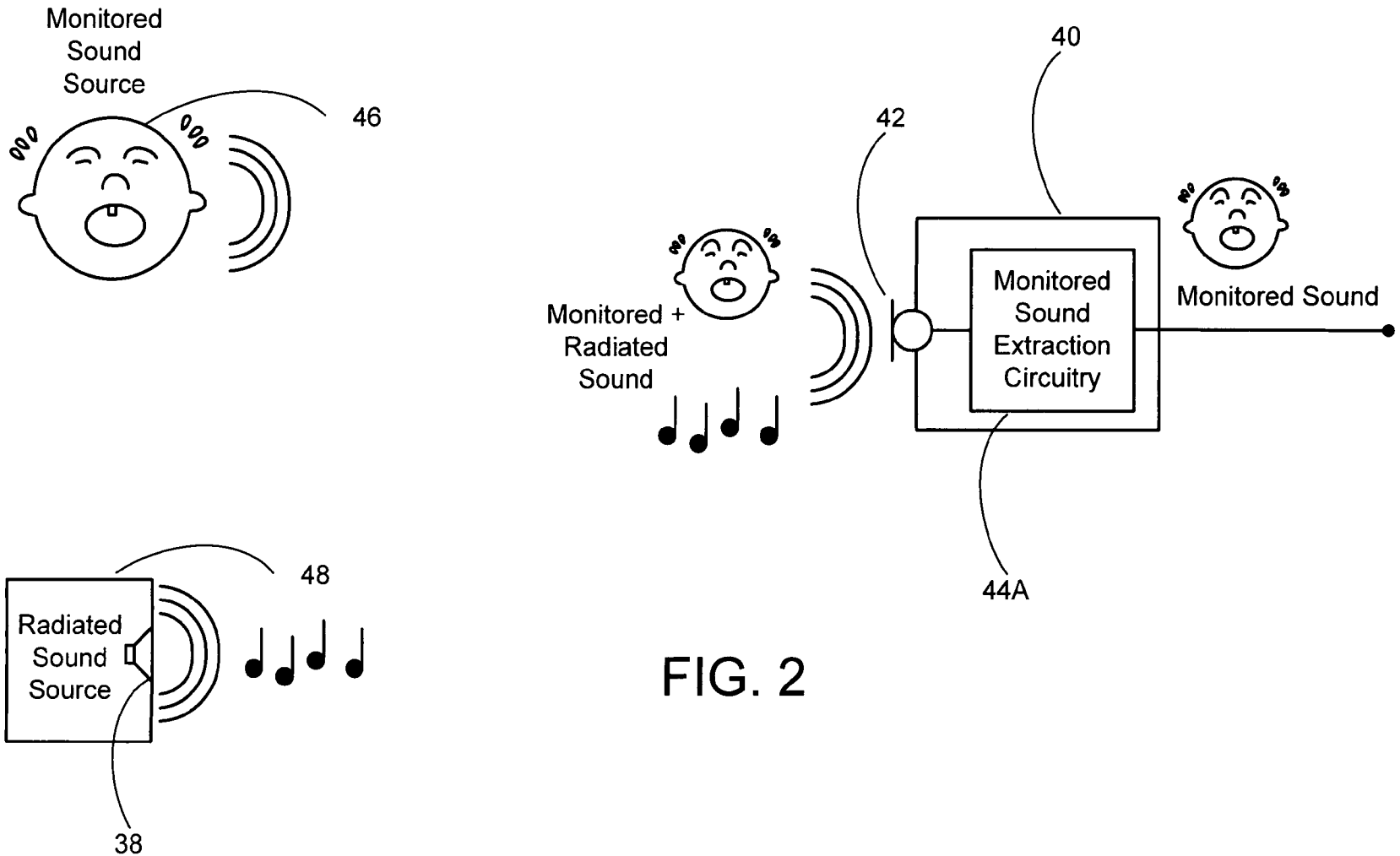
FIG. 2 is diagram of a person monitoring system.

According to FIG. 2, a monitored sound extractor 40 includes a microphone 42 and monitored sound extraction circuitry 44A coupled to the microphone. Microphone 42 receives, and transduces to an audio signal, sound waves resulting from acoustic radiation from a monitored sound source 46 and sound waves resulting from a radiated sound source 48, which includes an acoustic driver 38 and an audio signal source which will be discussed below. Monitored sound source extraction circuitry 44A extracts a monitored sound audio signal, typically by significantly attenuating the portion of the input audio signal that was transduced from the sound waves resulting from radiated sound source 48. The monitored sound source 46 is a person for which monitoring of sound from is desirable and to which radiating music or soothing sound is desirable, for example a baby or a bedridden injured or ill person. Sound waves resulting from radiated sound source 48 can include direct radiation and indirect radiation as modified by acoustic characteristics of the environment (room effects). The implementation of FIG. 2 is particularly suited to situations in which the monitored sound source and the radiated sound source are the most significant sound sources in the room.

Figure 3:
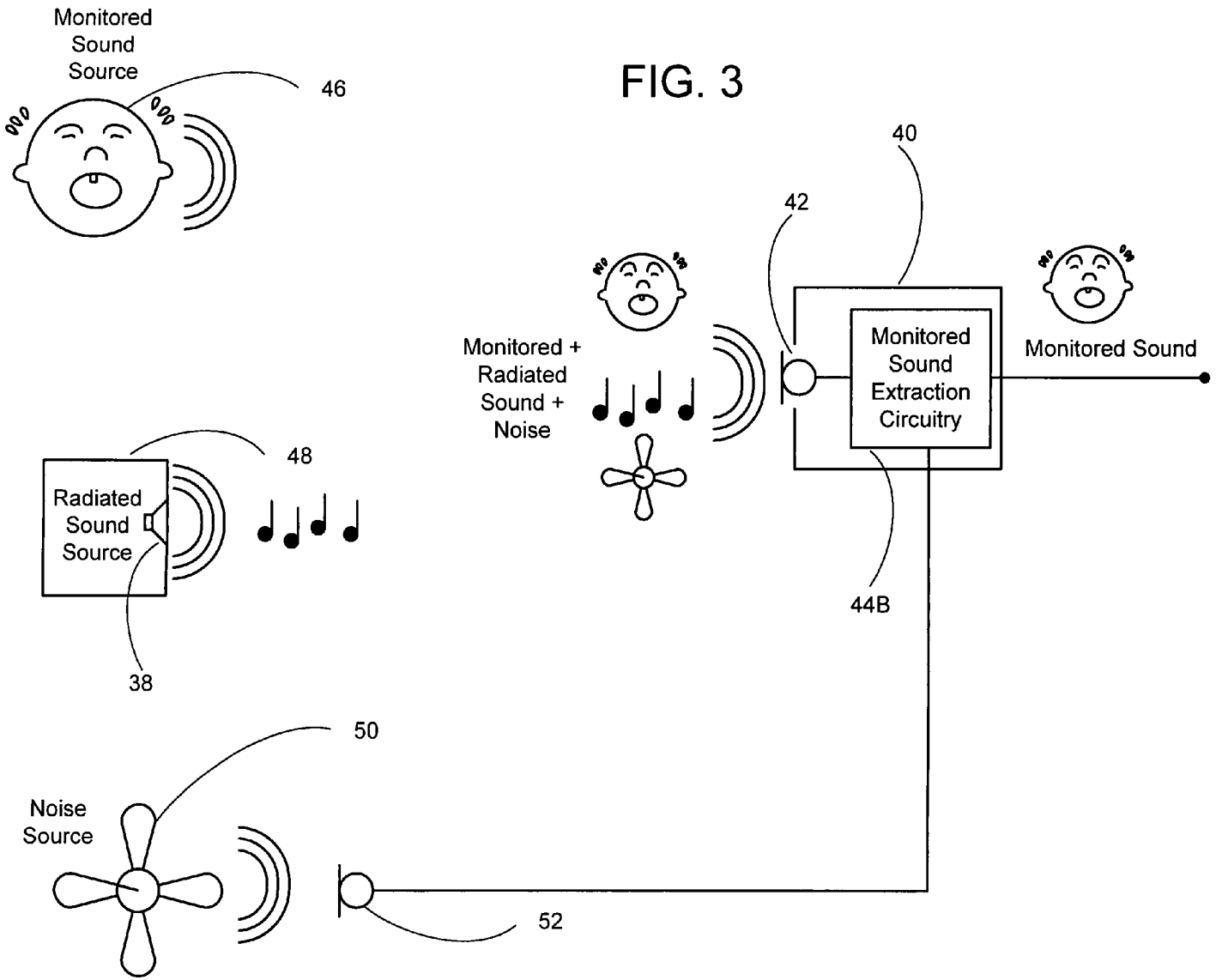
FIG. 3 is a diagram of another person monitoring system.

FIG. 3 includes the elements of FIG. 2 and also includes an acoustic noise source 50, for example a fan, air conditioner, or medical device, and a noise microphone 52, which is communicatingly coupled to monitored sound extraction circuitry 44B. The implementation of FIG. 3 functions as the implementation of FIG. 2, but the monitored sound extraction circuitry 44B also significantly attenuates the portion of the audio signal resulting from acoustic radiation from the acoustic noise source 50.

Figure 4A:
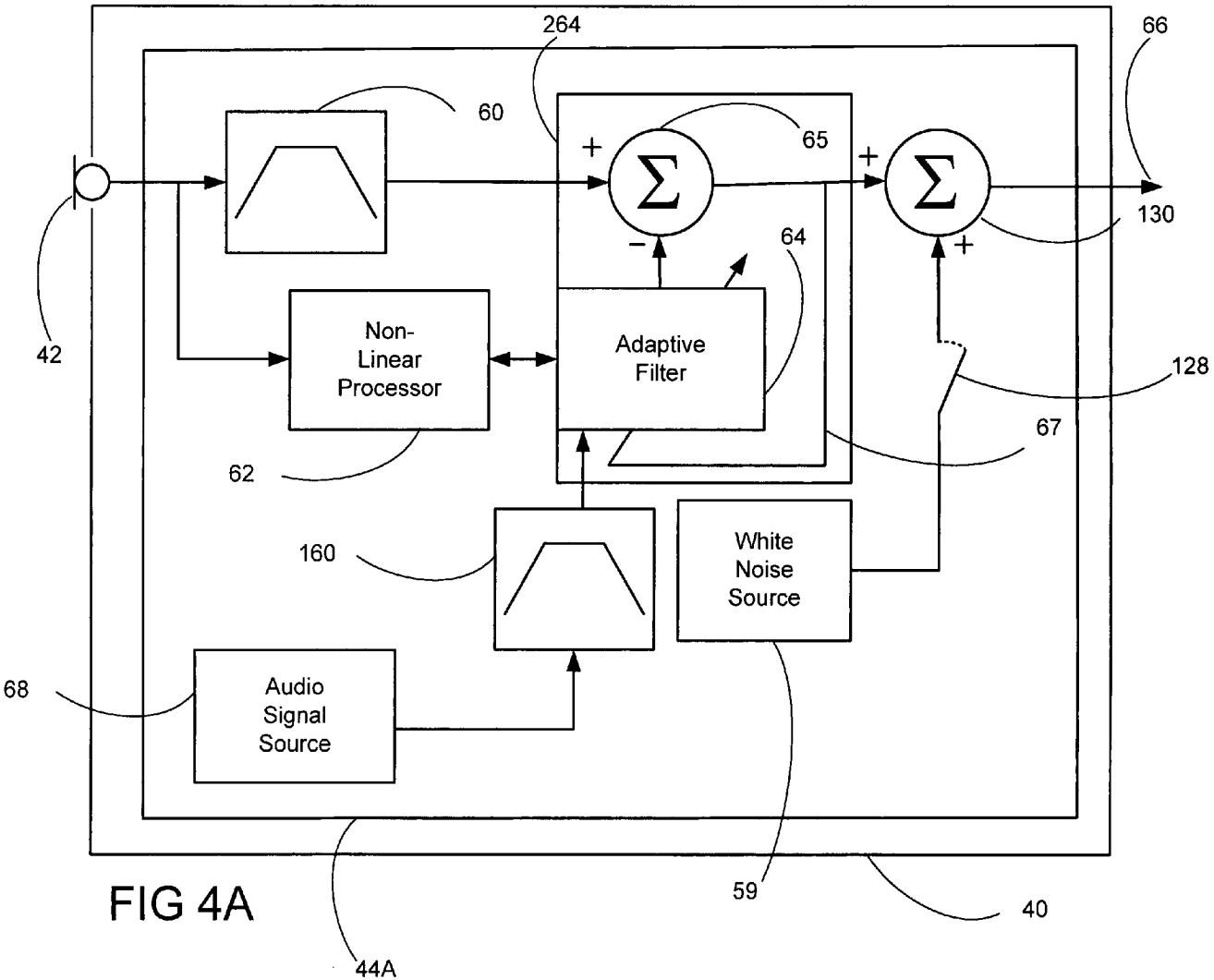
FIGS. 4A-4D are block diagrams of a monitored sound extractors.

Referring to FIG. 4A, there is a shown a block diagram of monitored sound extractor 40 showing monitored sound extraction circuitry 44A in more detail. Microphone 42 is coupled to band pass filter 60 and to non-linear processor 62. Band pass filter 60 is coupled to a filter circuit 264 including summer 65, adaptive filter 64, and feedback path 67. Output of filter circuit 264 is coupled to summer 130. White noise source 59 is coupled to summer 130 through switch 128. Non-linear processor 62 is coupled to adaptive filter 64. Audio signal source 68 is coupled to adaptive filter 64 by band pass filter 160. Summer 65 is coupled to summer 130, which is coupled to output terminal 66.

In operation, the audio signal from microphone 42, which represents sound from the monitored sound source and from the radiated sound source, is processed by band pass filter 60 to remove spectral contents of the audio signal outside a band of interest, such as the speech band. For example, a typical band pass filter 60 may have break points at 300 Hz and 3 kHz. Since the monitored sound is within the speech band, the filtering results in the loss of no useful data, and simplifies subsequent processing. The band passed audio signal is then processed by a filter circuit 264. The adaptive filter 64 modifies filter coefficients to minimize an error signal at the output of summer 65. The audio signal source provides to filter circuit 264 a strongly correlated reference with a spectral content similar to the spectral content of the band passed signal from the microphone 42. The strongly correlated signal permits the adaptive process to operate more efficiently. If the adaptive filter adapts properly and the error signal is minimized, the error signal approaches the sound radiated by the monitored sound source 46 of FIG. 2. The signal from the filter circuit 264 is transmitted to output terminal 66 for further processing as will be described below. Non-linear processor 62 may alter the operation of adaptive filter 64 to account for non-linear situations. For example, if some atypical event, for example a door slamming, a telephone ringing, or the microphone getting dropped, occurs, the non-linear processor may cause the adaptive filter to freeze the updating of coefficients for a period of time. If the signal from filter circuit 264 or the signal from microphone 42, or both, is below a minimum value for an extended period of time non-linear processor may mute the signal at the output terminal. The non-linear processor may also monitor the values of the filter coefficients and, if the coefficients are determined to be at some predetermined limit or condition, hold the adaptation of the coefficients or reset the filter coefficients if needed. White noise source 59 will be described in more detail below.

Microphone 42 may be a conventional omni-directional microphone, or may be a directional microphone as will be described below. Audio signal source 68 may be a CD player, an MP3 player, a flash memory, or some other digital storage medium, or a received broadcast, such as a radio transmission or some other analog source. As will be discussed below with regard to FIGS. 8A and 8B, the audio signal source may be internal to the monitored sound extractor 40, and attachment to sound extractor 40, or an external to the sound extractor 40 and transmitted to the sound extractor 40 by a wired or wireless connection. Band pass filters 60 and 160 may each be a conventional analog filter or a conventional digital filter with appropriate A/D or D/A converters. Adaptive filter 64 may be an n-tap delay line with a least mean squares (LMS) adaptive scheme; an n-tap delay line with a normalized LMS scheme; a block LMS scheme; a block discrete Fourier transform scheme; a Leguerre filter; an FIR filter, or others. In one embodiment, a system according to FIG. 4A, using a n-tap delay line (transversal filter) with an LMS adaptive scheme with 400 sample points, an 8 kHz sample rate, and an adaptation rate of 10/8000 coefficient updates per step, achieved >20 dB of sound source radiation removal. Suitable adaptive algorithms may be found in *Adaptive Filter Theory* by Simon Haykin, ISBN 0130901261, for example in Chapter 5. Non-linear processor 62 may be implemented as a suitably programmed digital signal processor.

Figure 4B:
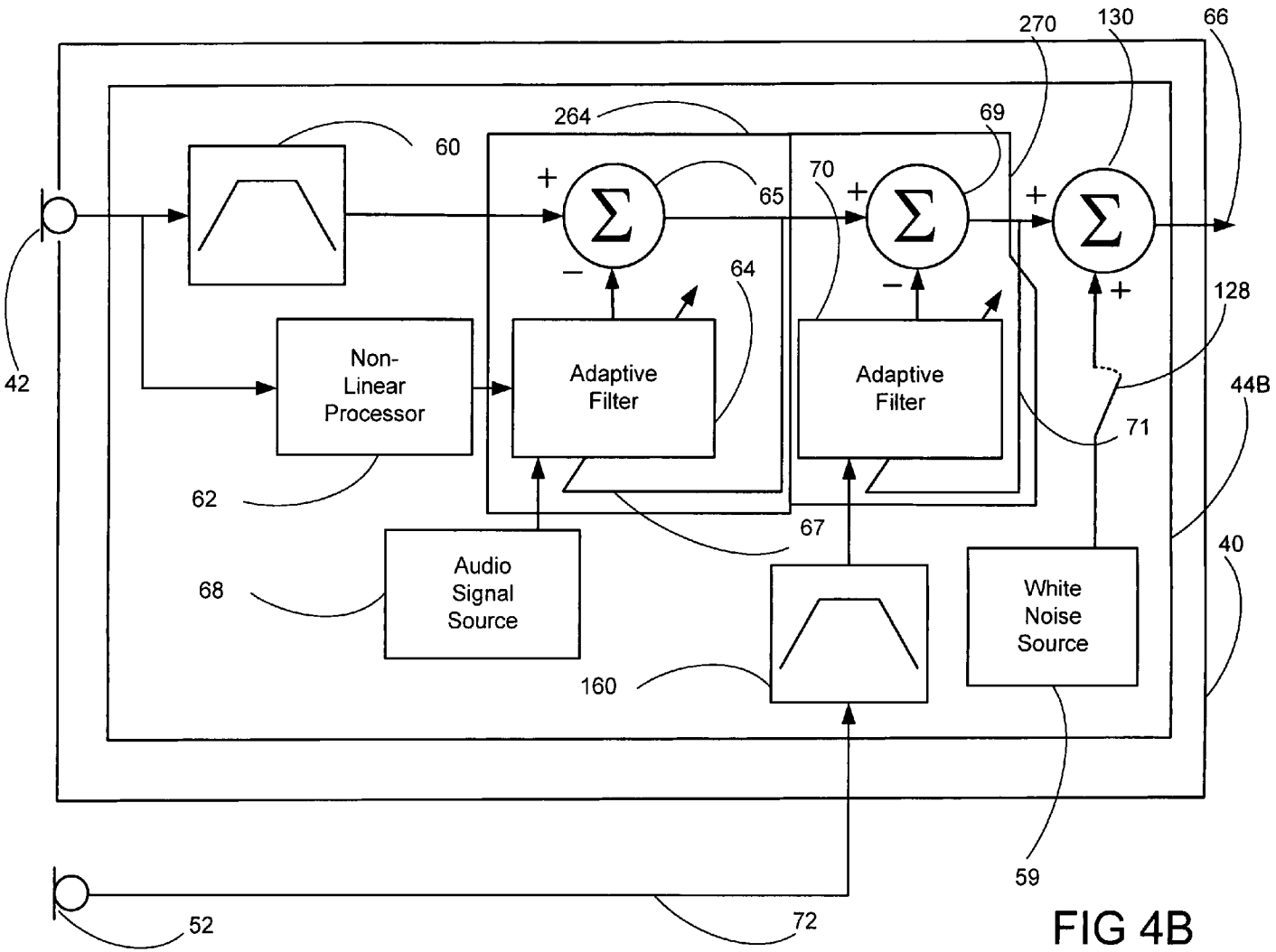

The implementation of FIG. 4B includes the elements of the implementation of FIG. 4A; the common elements have common reference numbers. In addition, the implementation of FIG. 4B includes the acoustic noise reduction elements of extraction circuitry 44B. Noise microphone 52 is coupled by signal line 72 and by band pass filter 160 to a noise filter circuit 270 including adaptive filter 70, an associated summer 69, and feedback path 71. The output of filter circuit 270 may couple filter circuit 264 to summer 130. White noise source 59 may be coupled to summer 130 through switch 71. Summer 130 is coupled to output terminal 66. Filter circuit 70 couples filter circuit 64 with The noise filter circuit 270 may operate in a manner similar to filter circuit 264, to eliminate noise from signal at the output terminal 66. Noise microphone 52 provides an estimate of the noise to provide a strongly correlated reference in a spectral range similar to the signals from filter circuit 264. The strongly correlated reference permits filter circuit 270 to operate more efficiently. For best results, noise microphone 52 may be a directional microphone, or should be positioned close to the noise source 50, or both. Directional microphones will be discussed in more detail below. The transmission of the microphone signal, represented by line 72 may be wired or wireless. Noise filter 70 may be an adaptive filter as shown which uses the signal from noise microphone 52 in a manner similar to which the adaptive filter 64 uses the input signal from audio signal source 68. Adaptive filters 64 and 70 are shown as separate filters. Alternatively, filter circuits 264 and 270 may be implemented as a single filter circuit with a single adaptive filter.

Figure 4C:
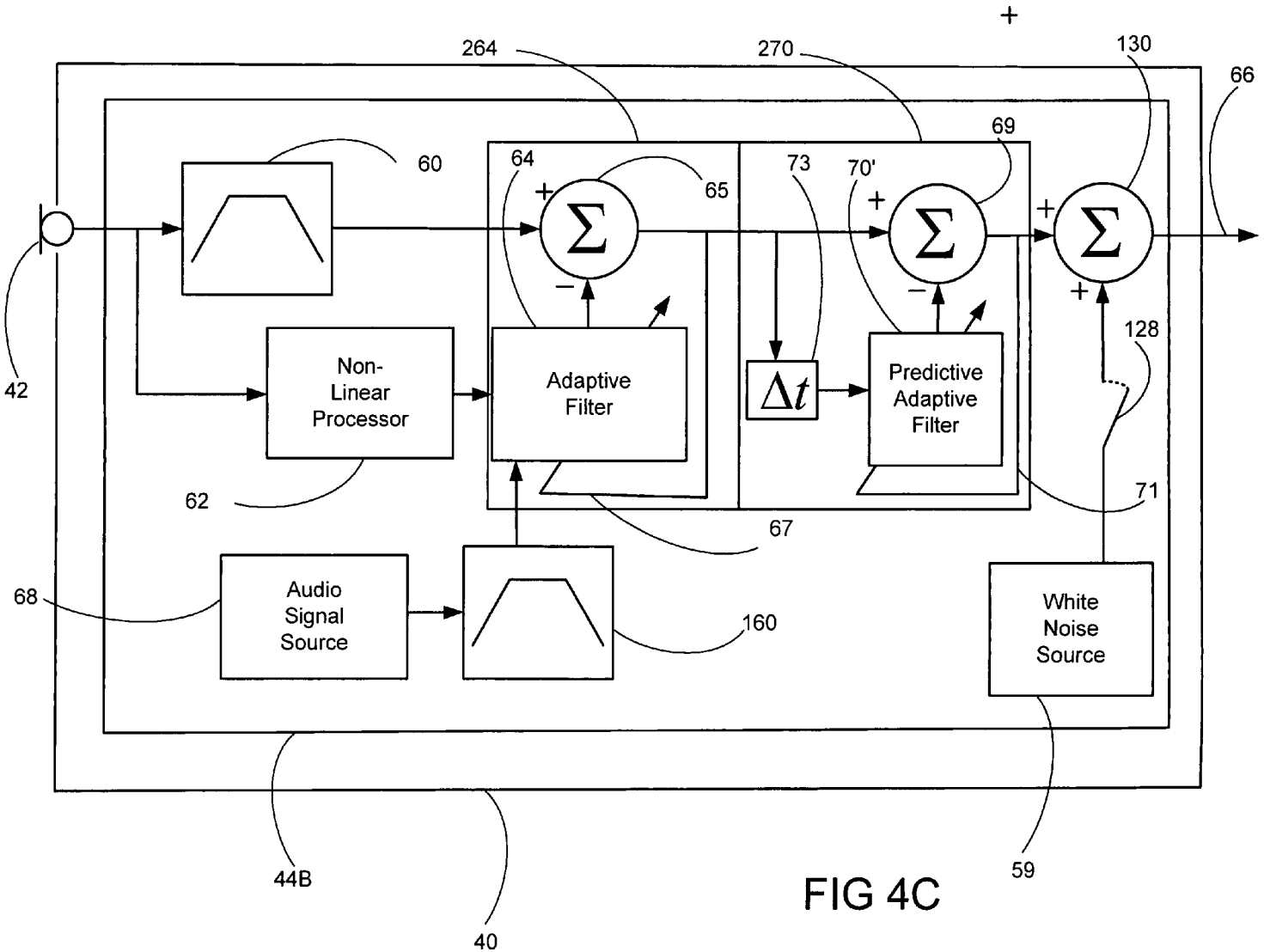

FIG. 4C shows a monitored sound extractor 40 with another implementation of monitored sound extraction circuitry 44B using a different form of adaptive filter. In the implementation of FIG. 4C, the filter circuit 270 includes a predictive adaptive filter 70', coupled to the output of the filter circuit 264. Time delay 73 couples predictive filter 70' with the output of filter circuit 264. The historical data from the output of filter circuit 264 provides filter circuit 270 with historical data that, similar to the band passed audio signal from audio signal source 68, permits filter circuit 270 to operate more efficiently.

Figure 4D:
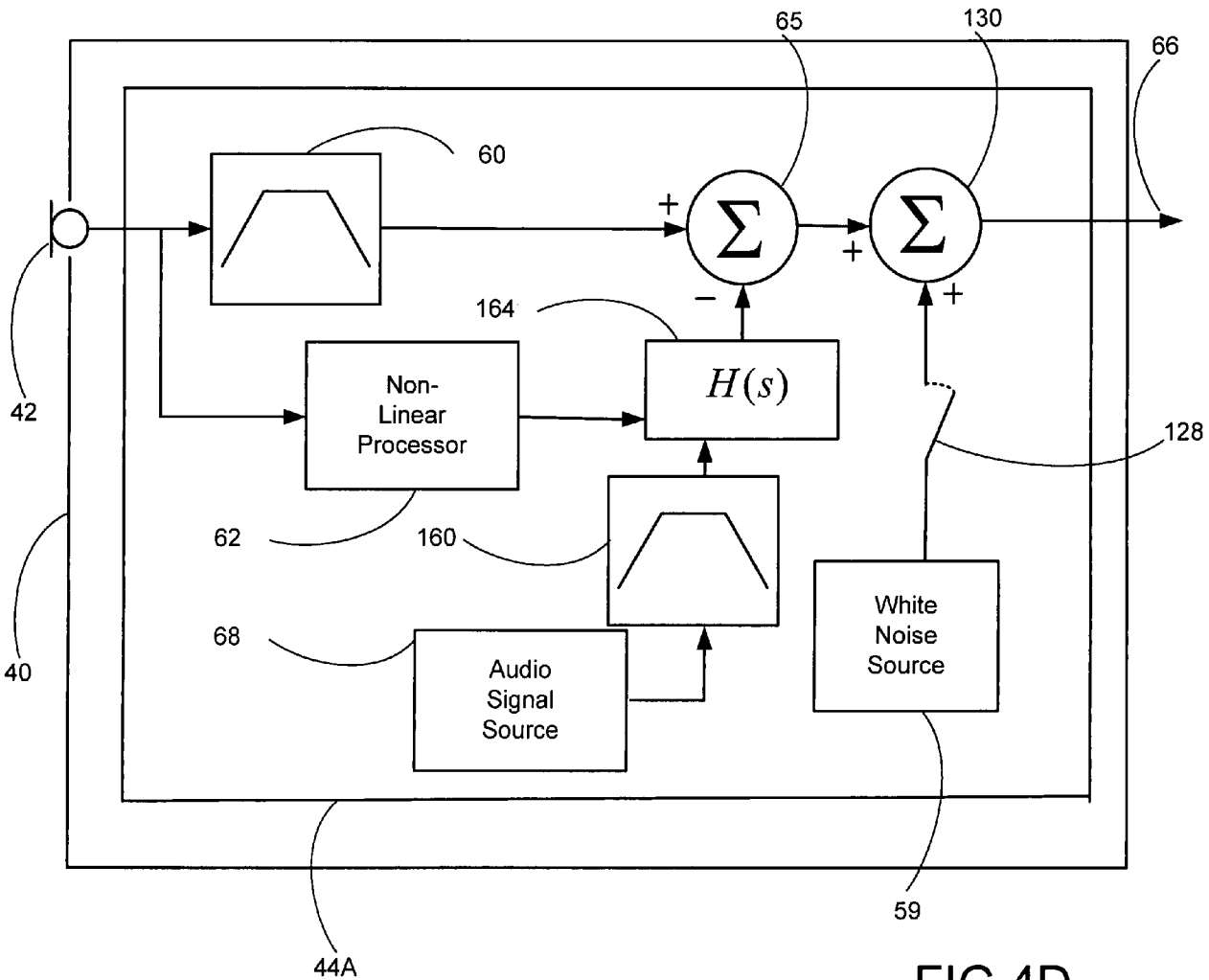

FIG. 4D shows another monitored sound extractor 40 with another implementation of monitored sound extraction circuitry 44A. Referring to FIGS. 3 and 4A, an audio signal representing an audio test pattern is transmitted from audio signal source is 68 to radiated sound source 48, which radiates, in the absence of sound from any other source, sound waves corresponding to the audio test pattern. The microphone 42 transduces the sound waves to a received audio signal. The adaptive filter 64 operates to drive the error signal at the output of summer 65 toward zero while the audio test pattern is transmitted for a period of time sufficient for the filter circuit to reach a minimum error condition, for example 20 seconds. Since acoustic radiation corresponding to the audio test signal is the only source of sound, this procedure causes the difference between the audio signal from microphone 42 and the audio signal from audio signal source 68 to represent the effect of the environment, such as room effects. Thereafter, the adaptive filter 64 of FIG. 4A operates as a fixed filter 164 of FIG. 4D. The filter is represented by a transfer function H(s), which filters from the audio signal received from microphone 42 the audio signal from audio signal source 68 as modified by the transfer function H(s), leaving substantially only an audio signal corresponding to sound radiated from the monitored sound source 46 of FIG. 3.

Figure 5:
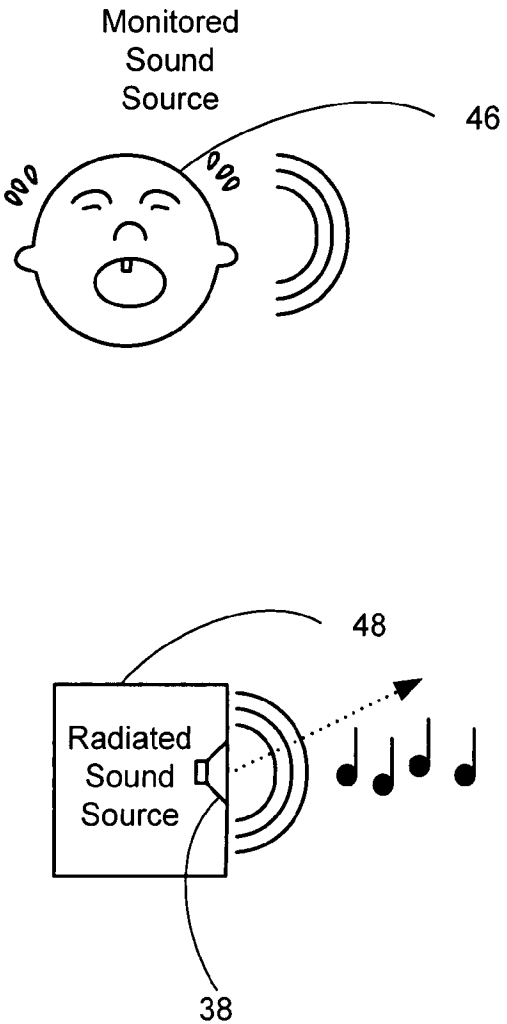
FIG. 5 is a diagram illustrating directional radiation and directional microphones.

The performance of the system may be improved further by the use of directional loudspeakers, directional microphones, or both, as shown diagrammatically in FIG. 5. Microphone 42 may be implemented as a directional microphone, so that the direction from monitored sound source 46 is a high response direction and so that the direction from the radiated sound source 48 is a low response direction. Radiated sound source 48 may be implemented as a directional loudspeaker with the direction toward microphone 42 being a low radiation direction.

Figure 6A:
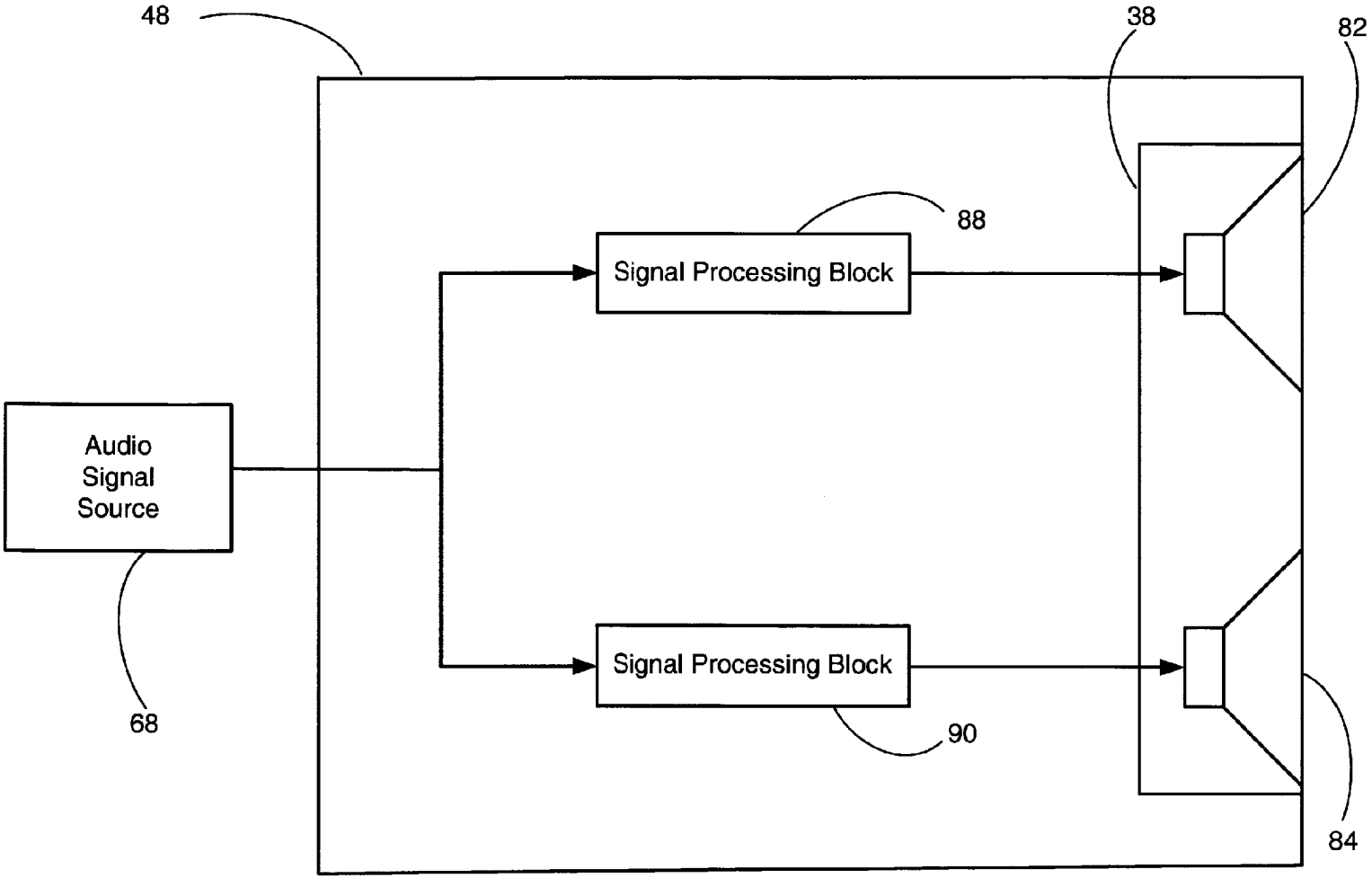
FIGS. 6A-6C are block diagrams of directional loudspeakers.

FIG. 6A shows a block diagram of one implementation of radiated sound source 48. Audio signal source 68 is coupled to signal processing blocks 88 and 90, each of which is coupled to an acoustic driver 82 and 84, respectively. Acoustic drivers 82 and 84 are components of a loudspeaker 38 that is a directional array. The signal processing blocks apply signal processing to the audio signals presented to them, to cause loudspeaker 38 to act as an acoustic array, as described in the references stated above in the discussion of FIG. 1.

Figure 6B:
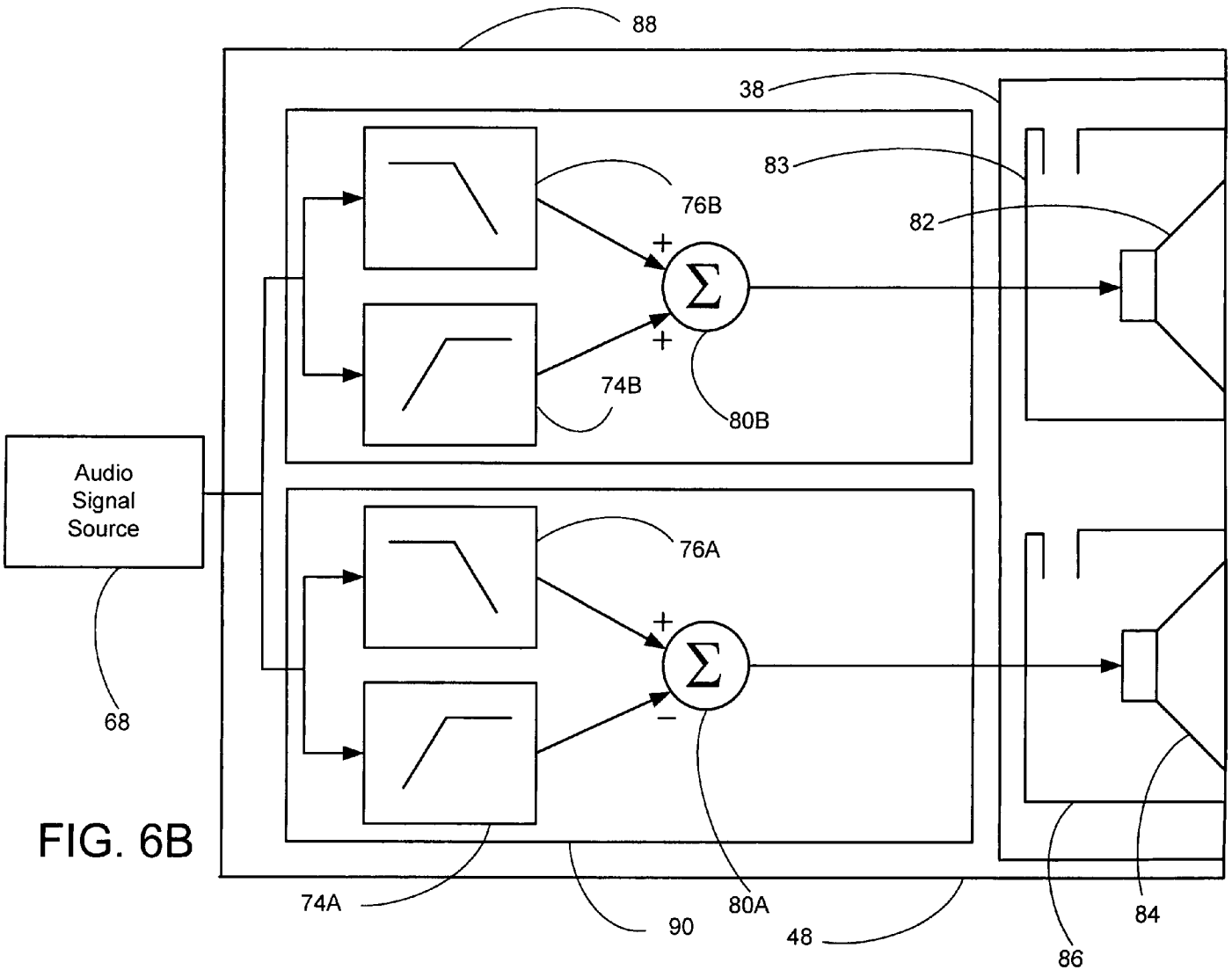

FIG. 6B shows one form of the implementation of FIG. 6A. In this implementation, signal processing block 90 includes a high pass filter 74A and low pass filter 76A. Low pass filter 76A is coupled to summer 80A. High pass filter 74A is differentially coupled to summer 80A. Summer 80A is coupled to acoustic driver 84. Signal processing block 88 includes elements similar to signal processing block 90, except that high pass filter 74B is coupled additively to summer 80B. Acoustic drivers 82 and 84 are each positioned in a ported enclosure, 83 and 86 respectively. The spacing and the orientation of acoustic drivers 82 and 84 and, if necessary, a time delay or phase adjuster (not shown) can be set to cause loudspeaker 38 to radiate directionally. Signal processing blocks 88 and 90 may also include other elements necessary for acoustic radiation, such as amplifiers, not shown.

In operation, an audio signal applied to signal processing block 90 is filtered by high pass filter 74A and low pass filter 76A. The low pass filtered signal is transmitted to summer 80A. The high pass filtered audio signal is transmitted to summer 80A where it is combined differentially (or equivalently, inverted and combined) with the low pass filtered audio signal. An audio signal applied to signal processing block 88 is filtered by high pass filter 74B and low pass filter 76B. The low pass filtered signal is transmitted to summer 80B. The high pass filtered audio signal is transmitted to summer 80B where it is combined with the low pass filtered audio signal. The audio signals presented to signal processing blocks are further processed (for example converted from digital form to analog form if needed, amplified, and conditioned) and transmitted to acoustic drivers 82 and 84, which radiate sound waves corresponding to the audio signal transmitted to them. The result of the signal processing of the arrangement of FIG. 6B is that the low frequency (for example, below 200 Hz) spectral portion is radiated in phase by acoustic drivers 82 an 84 and that the high frequency spectral portion (for example above 300 Hz) is radiated by acoustic drivers 82 and 84 out of phase. The frequencies between 200 Hz and 300 Hz are in the crossover portion of the high and low pass filters and are radiated with a phase relationship that varies as a function of frequency. In one implementation, the phase relationship varies monotonically from −0 degrees to −180 degrees from 200 Hz to 300 Hz; in another implementation, the relationship varies monotonically from −0 degrees to −180 degrees from 200 Hz to 500 Hz. Because the frequencies below 200 Hz are radiated by both acoustic drivers in phase, the loudspeaker can radiate substantial bass frequency radiation; the substantial bass radiation is significantly attenuated by band pass filter 60 of FIGS. 4A-4C. The frequencies above 300 Hz are radiated by acoustic drivers 82 and 84 out of phase, in accordance with the principles of the references disclosed in the discussion of FIG. 1. The frequencies above 300 Hz are radiated with a directional radiation pattern with high radiation directional and low radiation directions. The loudspeaker 86 can be placed so that the direction toward microphone 42 of FIGS. 2-4D is a low radiation direction (as shown in FIG. 5), which results in less radiated sound being picked up by microphone 42 than if the radiated sound were radiated non-directionally.

Figure 6C:
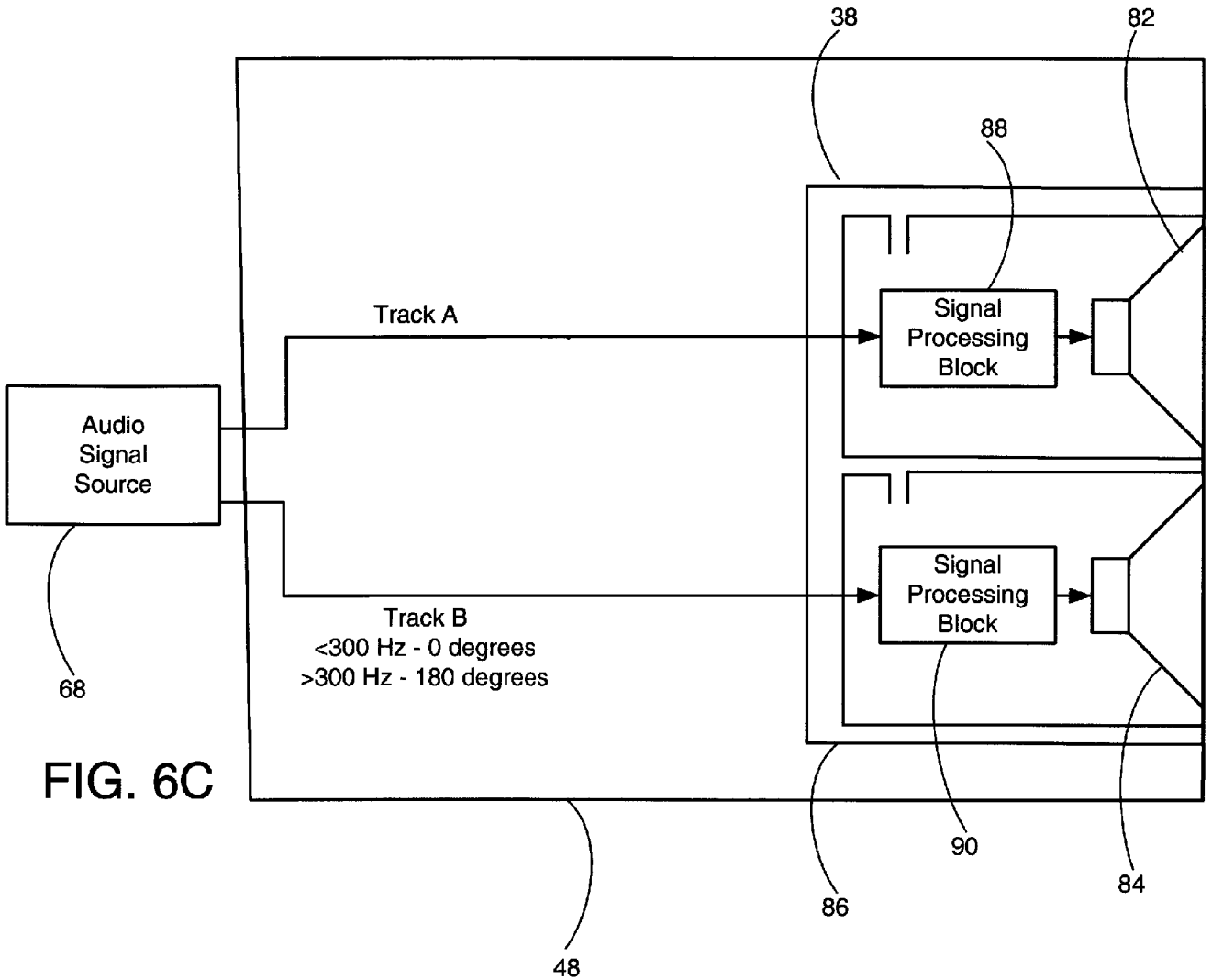

FIG. 6C shows an alternate radiated sound source 48. Audio signal source 68 is an at least two channel audio signal source. The tracks in channels A and B (referred to as tracks A and B, respectively) contain substantially identical content. At frequencies above 300 Hz, the signal of channel B is shifted 180 degrees relative to channel A. This arrangement provides the same benefit as the arrangement of FIG. 6A but eliminates the need for the filters and summers of the arrangement of FIG. 6A and additionally enables the audio signals to be produced using more aggressive phase transition from 200 to 300 Hz because the audio signal content can be pre-processed at a content creation facility with equipment having more computing capability than is practical to include in each radiated sound source unit.

Figure 7:
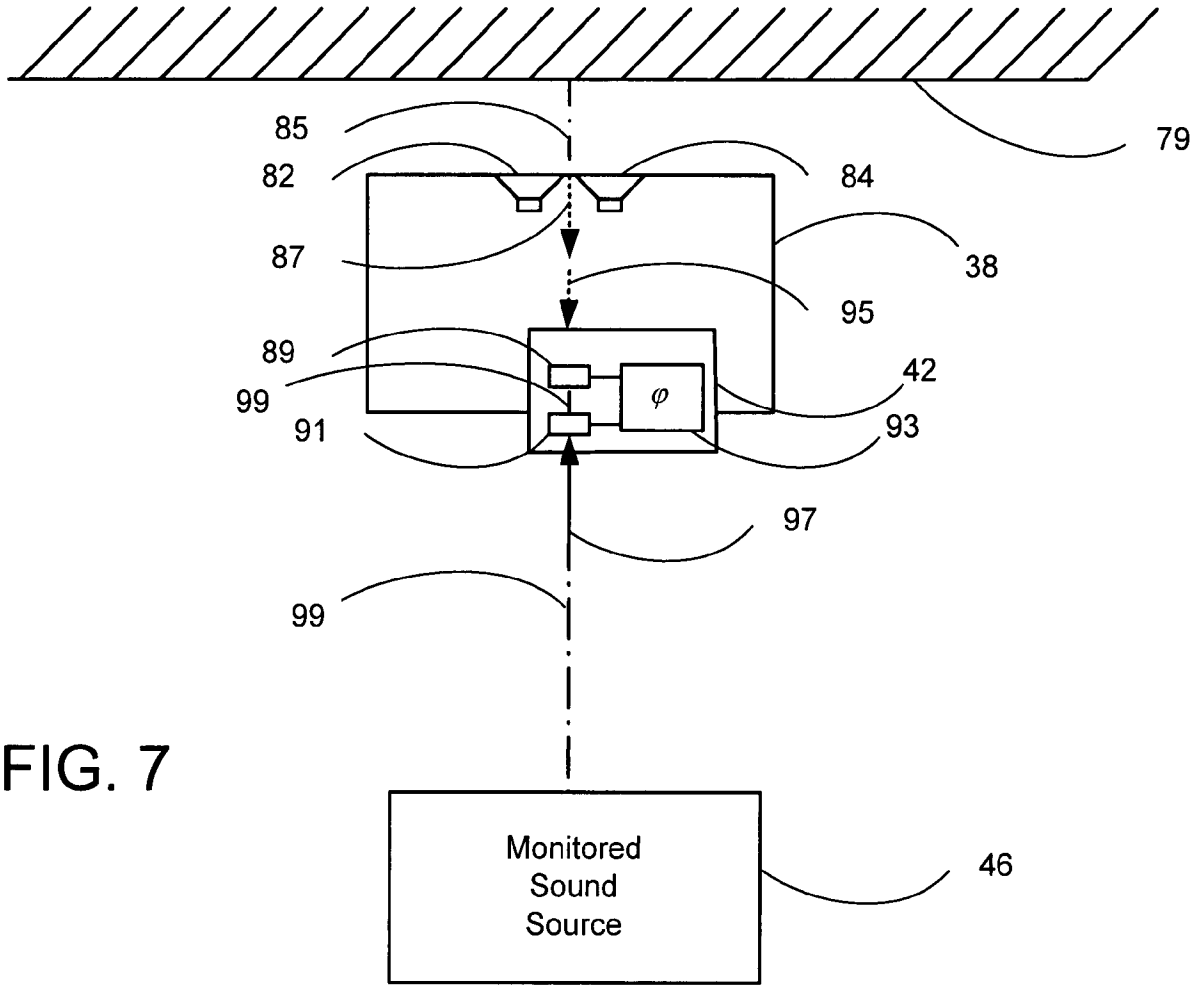
FIG. 7 is a block diagram of a loudspeaker and microphone arrangement.

FIG. 7 shows a top diagrammatic view of a loudspeaker and microphone arrangement suitable for use with the monitored sound extractor. Loudspeaker 38 is placed so that a center line 85 between acoustic drivers 82 and 84 is perpendicular to a line connecting acoustic drivers 82 and 84 and passes through monitored sound source 46. Processing is applied by processing blocks 88 and 90 of FIGS. 6A and 6B, resulting in direction 87 toward microphone 42 being a low radiation direction. Loudspeaker 38 may be placed so that acoustic drivers 82 and 84 face a wall 79. Omni-directional microphones 89 and 91 are placed a few inches apart and so that a line 99 passing through them passes through monitored sound source 46. The audio signals from the microphones 89 and 91 are processed by phasing circuitry 93 to provide a phase difference and polarity relationship between the audio signals from microphones 89 and 91. The amount of phase difference and the polarity relationship can be determined so that direction 95 toward acoustic drivers 82 and 84 is a low response direction and so that direction 97 toward monitored sound source 46 is a high response direction. In some implementations, especially digital signal processing implementations, the function of phasing circuitry 93 can be done by a time delay. In one example, the polarity is inverted and the phase difference is set to result in a cardioid pickup pattern, as in polar plot 20 of FIG. 1. Other types of directional microphones can be use, for example cardioid electret microphones or other types of single or multiple element directional microphones.

Figure 8A:
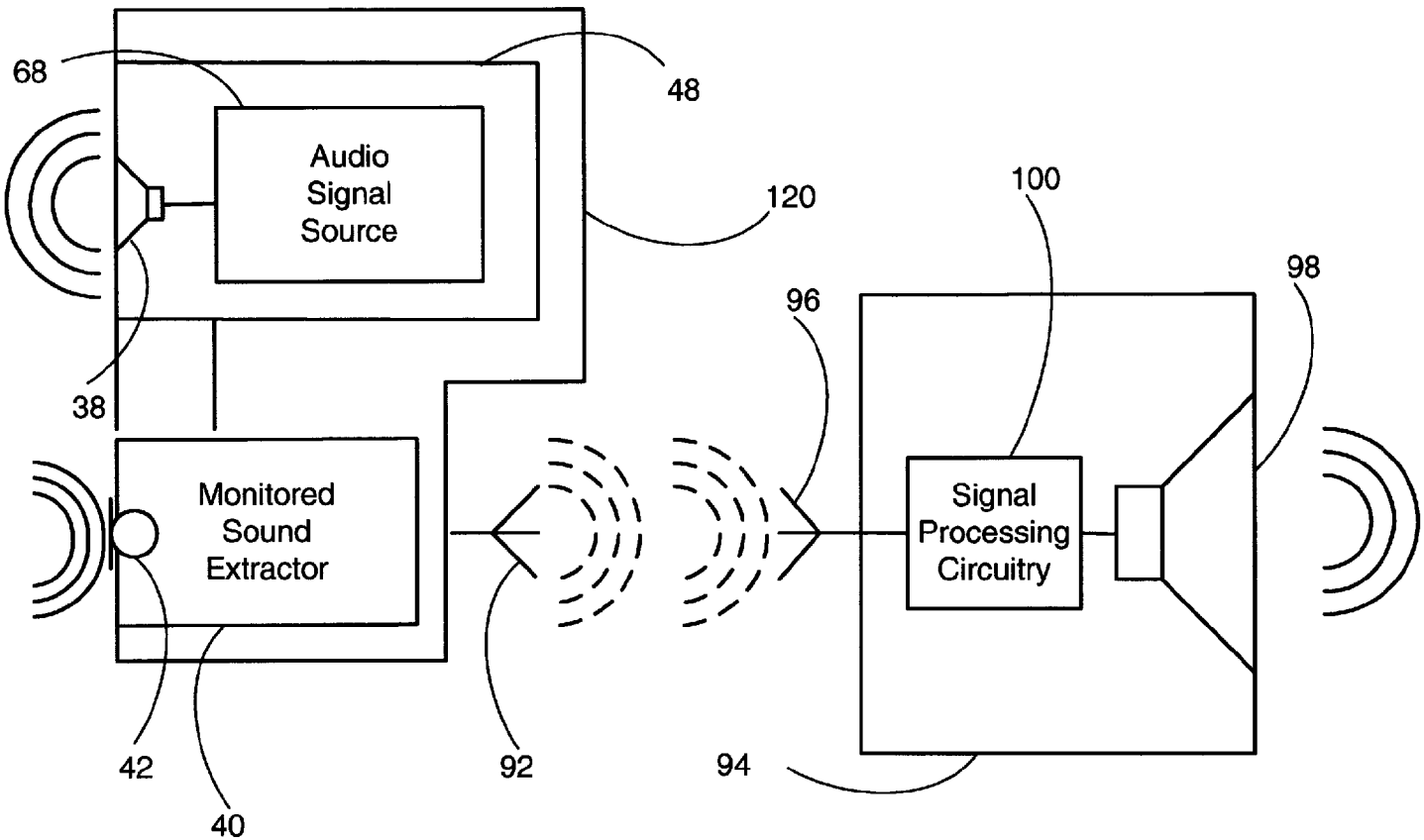
FIGS. 8A-8E are block diagrams of person monitoring systems.

FIG. 8A shows an arrangement of the devices previously described, and additionally includes devices for further processing the output signal from the monitored sound extractor. In FIG. 8A, the radiated sound source 48 and the monitored sound extractor 40 are housed in a common device, a combined monitored unit 120. The output terminal 66 of FIGS. 4A and 4B of the extractor is coupled through appropriate circuitry, not shown, to antenna 92. A monitoring unit 94 includes an antenna 96 coupled to acoustic driver 98 by signal processing circuitry 100. In operation, monitored sound extractor 40 operates as described above and radiates the audio signal via antenna 92 to monitoring unit 94 via antenna 96. The audio signal is processed by circuitry 100 and transduced by acoustic driver 98 to sound waves, similar to the sound waves from monitored sound source 46 of FIGS. 2, 3, and 5.

Figure 8B:
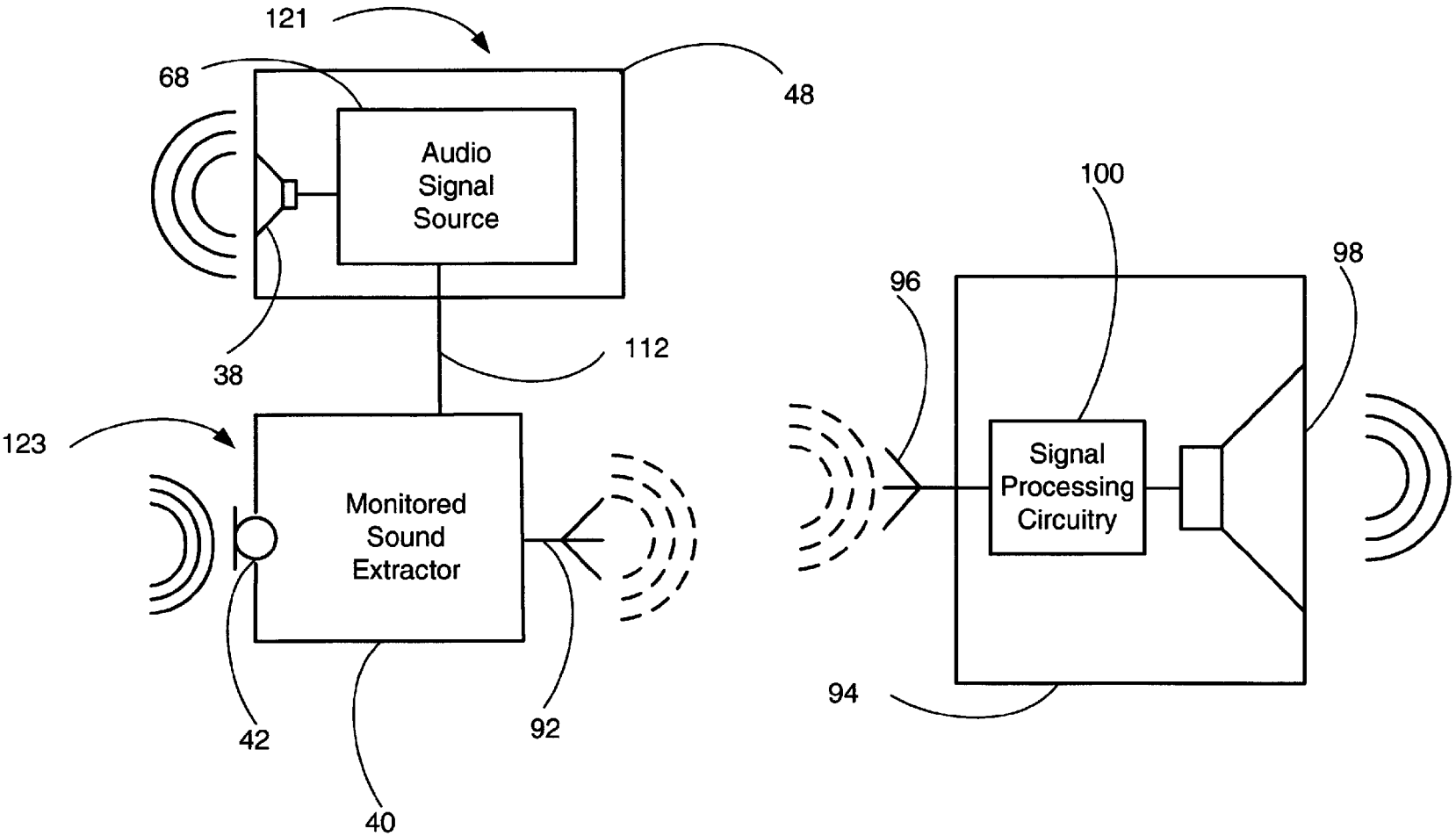

FIG. 8B shows another configuration of the elements of FIG. 8A. Radiated source 48 is housed in a unit 121 separate from a unit 123 housing monitored sound extractor 40. The audio signal from the audio signal source 68 is transmitted to the monitored sound extractor 40 by a cable 112 or, alternatively, by a wireless transmission arrangement.

Figure 8C:
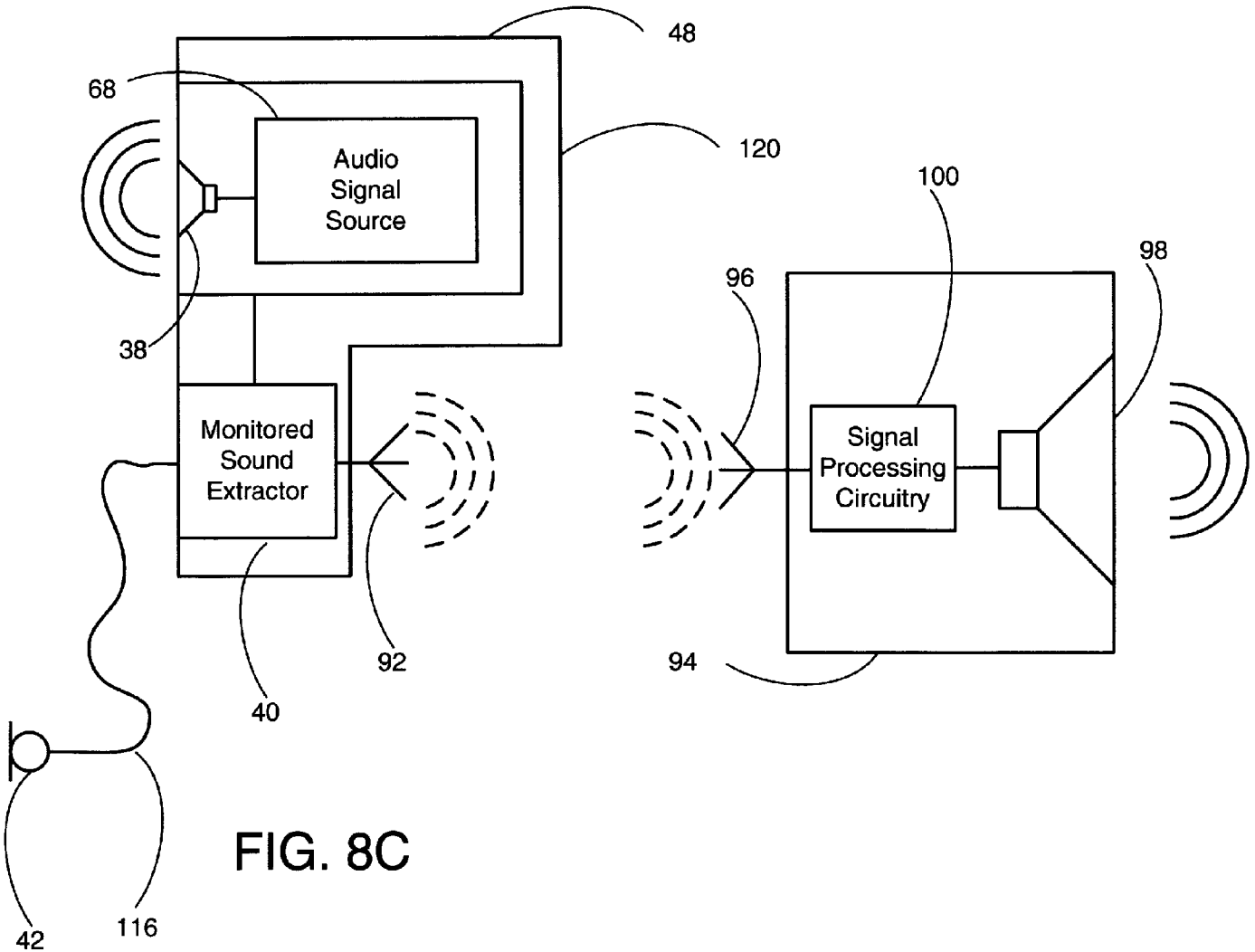

FIG. 8C shows another configuration of the elements of FIGS. 8A and 8B. The arrangement of FIG. 8C is arranged similarly to the arrangement of FIG. 8A, except that the microphone 42 is remote, that is, significantly closer to the monitored sound source than to the combined monitored unit, and communicates with the monitored sound extractor 40. For simplicity, the connection between microphone 42 and combined monitored unit 120 is shown as a physical connection 116, such as a cable. The physical connection may be eliminated by providing wireless transmission from the microphone to the monitored sound extractor 40.

Figure 8D:
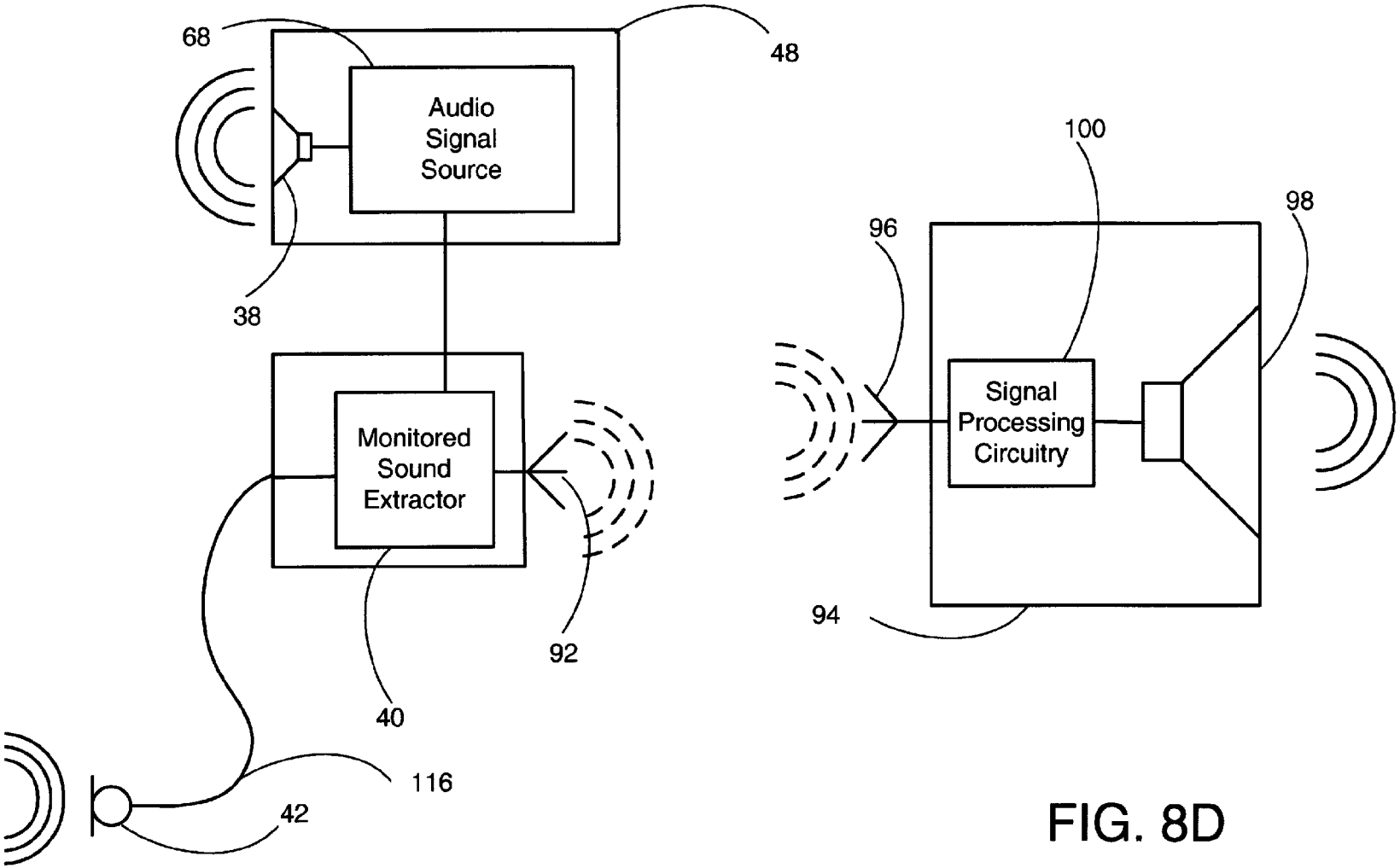

FIG. 8D shows another configuration of the elements of FIGS. 8A-8C. The elements of FIG. 8D are arranged similarly to the elements of FIG. 8B, but microphone 42 is remote, similar to the configuration of FIG. 8C. As in FIG. 8C, physical connection 116 can be eliminated by providing wireless transmission from the microphone to the monitored sound extractor.

Figure 8E:
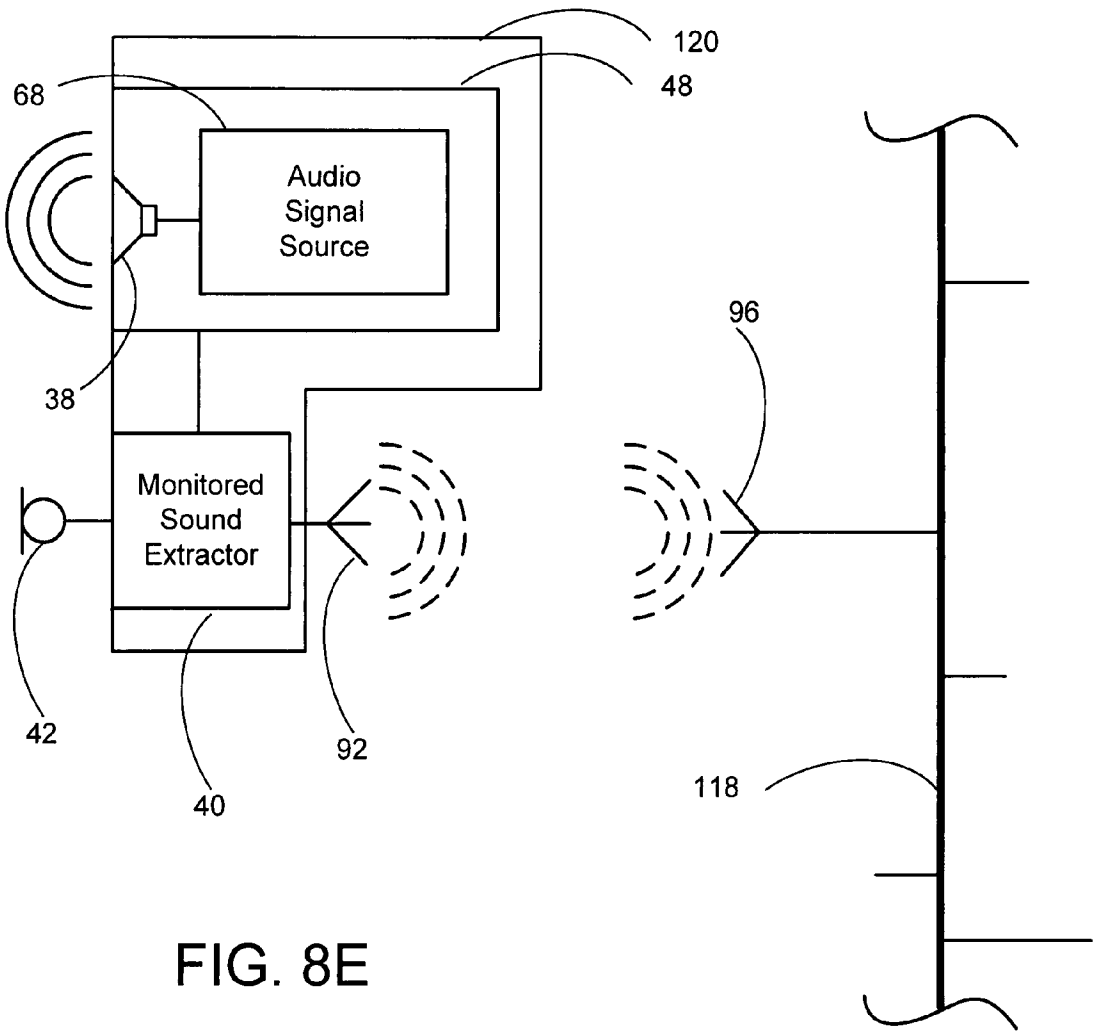

FIG. 8E shows yet another configuration of the elements of FIGS. 8A-8D, with an additional element. In FIG. 8E, combined monitored unit 120 communicates wirelessly through antennas 92 and 96 with network 118. The combined monitored unit of FIG. 8E can be replaced by separate radiated sound source 48 and monitored sound extractor 40, as in FIGS. 8B and 8D. The wireless communication elements can be replaced with wired communication elements.

Referring again to FIG. 4A, if there if there is no acoustic radiation from monitored sound source 46 of FIGS. 2 and 3, the non-linear processor 62 may disable the adaptive filter, and transmit white noise from white noise source 59 to the monitoring unit 94 of FIGS. 8A-8D, by closing switch 128 or by some other equivalent method. The transmission of white noise (or some other equivalent sound) provides audible indication to the caregiver that the transmission path from the monitored sound extractor 40 to the monitoring unit 94 is operative.

The systems of FIGS. 8A-8E can be used as person monitors. Music or soothing sound can be played to the person. Sounds from the person can be remotely heard by a caregiver, but the caregiver hears no or significantly attenuated music or soothing sound. The system of FIG. 8A can be used like a conventional baby monitor and is advantageous because housing the radiated sound source in the same unit as the microphone simplifies making the direction from the loudspeaker 38 to the microphone 42 a low radiation direction and also simplifies making the direction from the microphone to the loudspeaker a low response direction. The systems of FIGS. 8B and 8D can use for radiated sound source 48 a conventional sound source that may be already available to the user. In the systems of FIGS. 8C and 8D, the microphone can be placed very close to the person being monitored. This reduces, and may eliminate, the need for a directional microphone. In the system of FIG. 8E, the monitoring unit may be integrated into an existing audio network. For example, if a caregiver is watching a DVD in a family room or living room, if the sound from the monitored sound extractor 40 exceeds a threshold amount, the audio signal from the monitored sound extractor 40 may interrupt the signal from the DVD. An audio network providing for audio signal transmission and command signal transmission it described in co-pending U.S. patent application Ser. No. 10/863,650.

Figure 9A:
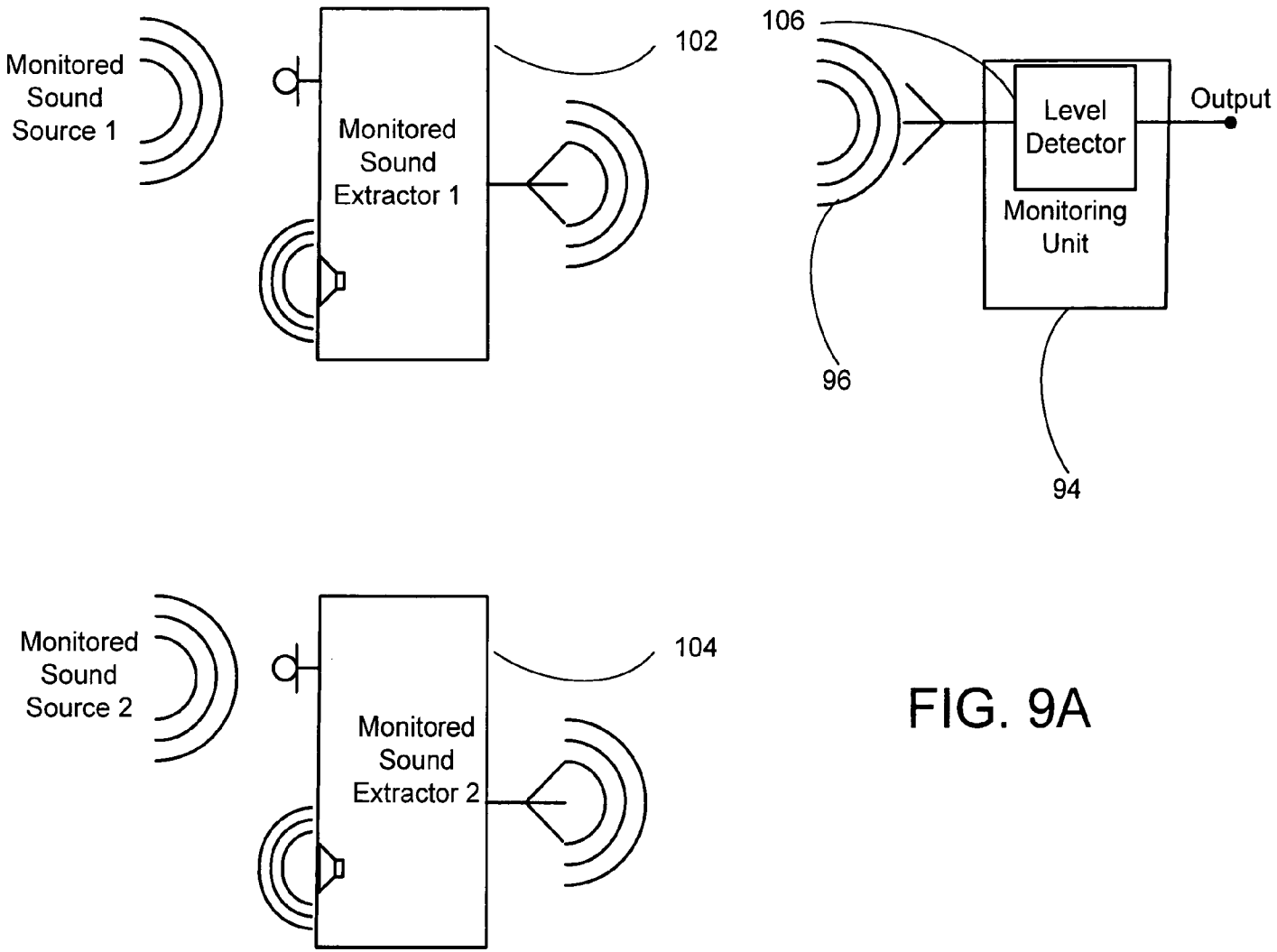
FIGS. 9A-9B show arrangements of monitored sound extractors and monitoring units.

FIG. 9A shows an arrangement in which there are two monitored sound extractors 102 and 104 and one monitoring unit 94. Antenna 96 of monitoring unit 94 can receive wirelessly transmitted signals from both monitored units 102 and 104. In one implementation, the transmitted signals from both monitored units 102 and 104 are mixed and transduced to sound waves, so that a caregiver can monitor both monitored units simultaneously. Alternatively, circuitry in monitoring unit 94 can allow a caregiver to select which monitored unit to monitor or can alternately monitor each of the monitored units for a set or selected period of time. In another alternative arrangement, shown in FIG. 9A level detector 106 can monitor and compare the amplitudes of the signals from the two monitored units 102 and 104, and can cause the monitoring unit to provide as output (typically by transducing to sound waves) the signal from the monitored unit associated with the monitored sound source that is radiating the highest amplitude signal.

Figure 9B:
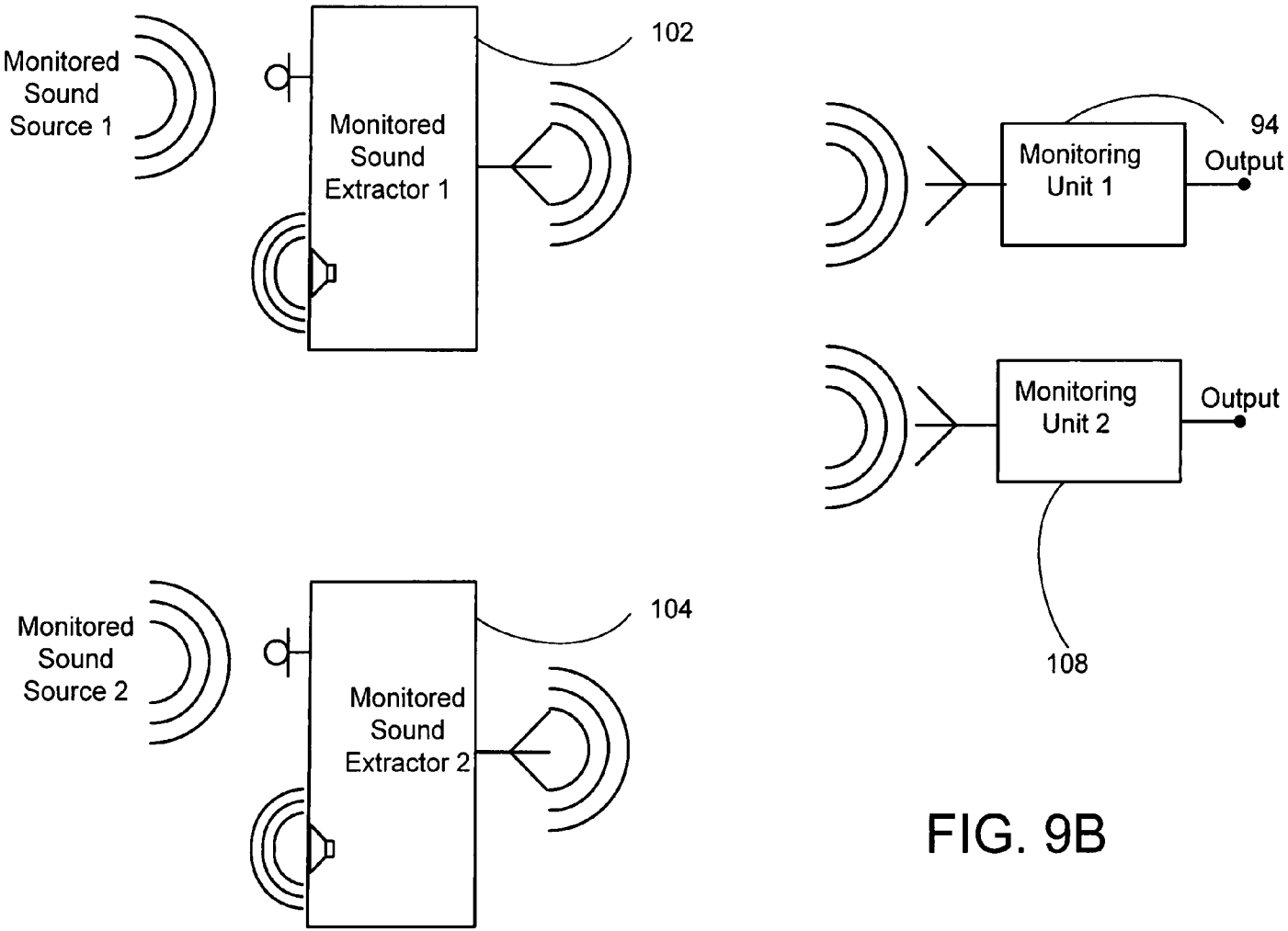

FIG. 9B shows the arrangement of FIG. 9A with an additional monitoring unit 108. Monitoring unit 108 may include circuitry which provides monitoring unit 108 with the same capabilities as monitoring unit 94, including level detector 106 of FIG. 9A. In FIGS. 9A and 9B, the monitored sound extractors may be included in the same housing as the radiated sound source, as in FIG. 8A, or may be housed separately from the radiated sound source, as in FIG. 8*b*.

Figure 10:
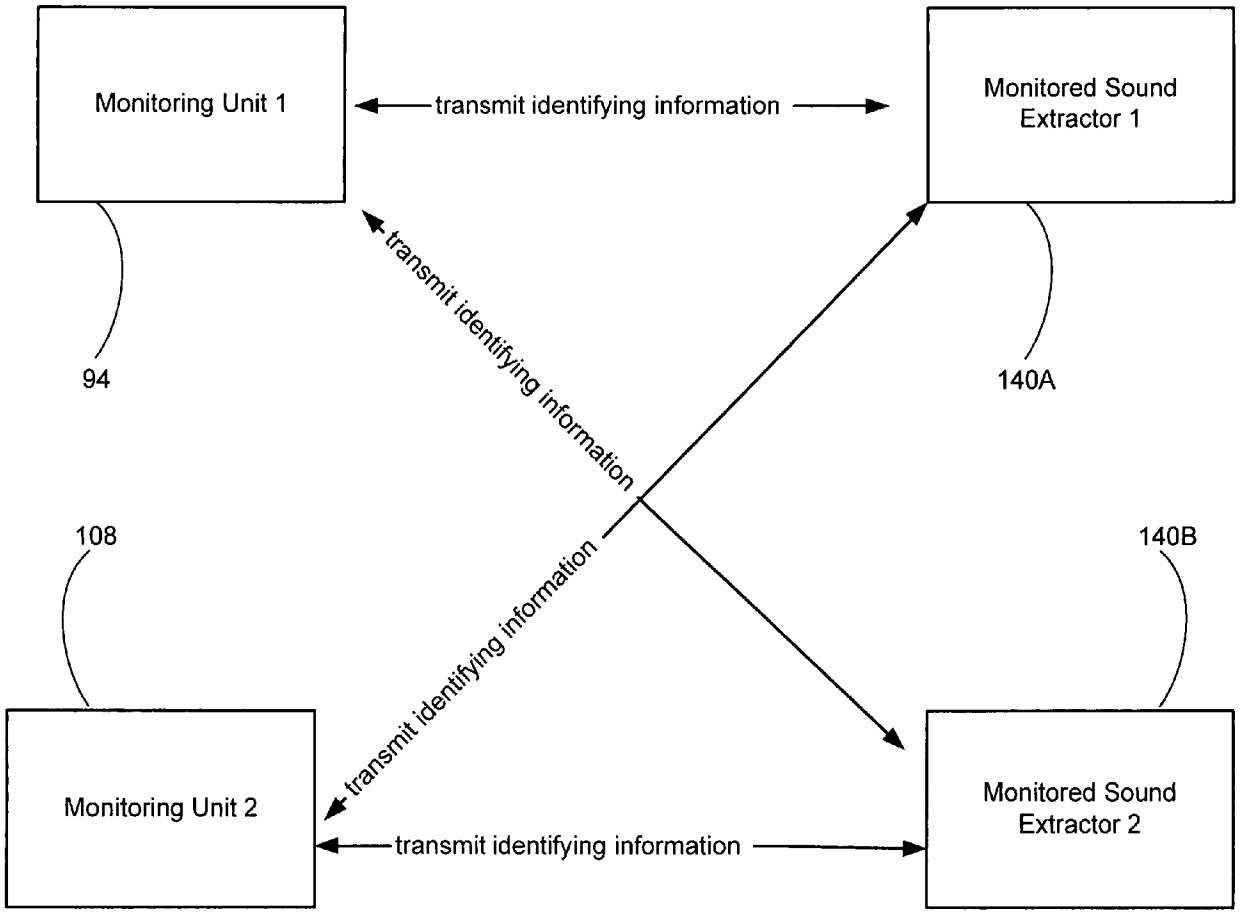
FIG. 10 illustrates a process for exchange of information between monitoring units and monitored units.

FIG. 10 illustrates diagrammatically a process by which monitoring units 94 or 108 can be caused to exchange and process information from selected monitored units and to not exchange and process information from other monitored units, such as monitored units is an adjacent apartment. According to FIG. 10, monitoring unit 94 exchanges identifying information with monitored sound extractors 140A and 140B. Monitoring unit 108 also exchanges identifying information with monitored sound extractors 140A and 140B. The identifying information is stored in a memory. Thereafter, monitoring units 94 and 108 process only signals (for example an audio signal representing sound from monitored sound source 46) transmitted from monitored sound extractors 140A and 140B and does not process signals from other monitored sound extractors. Monitored sound extractors 140A and 140B process only signals (for example, acknowledgements and commands) from monitoring units 94 and 108 and not from other monitoring units. As in FIGS. 9A and 9B, the monitored sound extractors may be included in the same housing as the radiated sound source, as in FIG. 8A, or may be housed separately from the radiated sound source, as in FIG. 8B.

Identifying information can be any convenient identifier, such as IEEE Standard 802.3 medium access control (MAC) identifiers. Exchange of identifying information can be initiated by a user, for example, by simultaneously activating a control on the monitoring unit and the monitored sound extractors which could cause the devices to transmit the identifying information and a message that indicates that the transmission is for the purpose of exchanging identifying information. If a monitoring unit and a monitored sound extractor are initially provided to the user as a matched pair, the exchange of identifying information can be done at manufacture in an automated fashion.

A person monitoring system according to FIG. 10 is advantageous because the system can be expanded by adding additional monitoring units and additional monitored sound extractors as add-on items subsequent to initial installation. The added devices can be "trained" to exchange information only with intended devices and not with devices in, for example, an adjacent apartment.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. A person monitoring system comprising:

a monitored unit comprising a microphone for transducing radiated sound waves and sound waves emanating from the person to a received audio signal and circuitry for removing from the received audio signal a portion of the received audio signal corresponding to the radiated sound waves to provide a first processed received audio signal corresponding to the sound waves emanating from the person, the monitored unit further comprising:

an audio signal source for providing a source audio signal; and a loudspeaker for transducing the source audio signal to provide the radiated sound waves.

2. A person monitoring system in accordance with claim 1, the monitored unit further comprising:

a unitary housing for the audio signal source, the microphone, and the circuitry.

3. A person monitoring system in accordance with claim 1, wherein the monitored unit comprises transmitting circuitry to wirelessly broadcast the first processed received audio signal to provide a broadcast processed received audio signal, the monitoring system further comprising a monitoring unit, the monitoring unit comprising receiving circuitry for receiving the broadcast processed received audio signal; and a transducer for transducing the broadcast processed received audio signal to sound waves.

4. A person monitoring system in accordance with claim 2, wherein the microphone is constructed and arranged to remotely transduce the radiated sound waves and the sound waves emanating from the person to provide the received audio signal and further constructed and arranged to transmit the received audio signal to the removing circuitry.

5. A person monitoring system in accordance with claim 4, wherein the microphone is constructed and arranged to transmit wirelessly the received audio signal.

6. A person monitoring system in accordance with claim 1, the monitored unit further comprising a first housing for the microphone and the removing circuitry and a second housing, separate from the first housing for the audio signal source and the loudspeaker.

7. A person monitoring system in accordance with claim 1, the monitored unit further comprising:

transmitting circuitry for transmitting the first processed received audio signal to a monitoring device.

8. A person monitoring system in accordance with claim 7, wherein the monitoring device is a network for providing the first processed received audio signal to devices accessible by the network.

9. A person monitoring system in accordance with claim 1, the monitored unit further comprising:

transmitting circuitry to transmit the first processed received audio signal.

10. A person monitoring system in accordance with claim 9, further comprising:

a first monitoring unit, comprising receiving circuitry for receiving the transmitted first processed received audio signal from the monitored unit.

11. A person monitoring system in accordance with claim 10 further comprising a second monitoring unit comprising receiving circuitry for receiving the first transmitted processed received audio signal from the monitored unit.

12. A person monitoring system in accordance with claim 9, wherein the transmitting circuitry comprises circuitry to wirelessly broadcast the first processed received audio signal to provide a broadcast processed received audio signal.

13. A person monitoring system in accordance with claim 12, further comprising:

a monitoring unit, the monitoring unit comprising receiving circuitry for wirelessly receiving the broadcast processed received audio signal.

14. A person monitoring system in accordance with claim 13, the monitoring unit further comprising a transducer for transducing the broadcast processed received audio signal to sound waves.

15. A person monitoring system in accordance with claim 9, further comprising a monitoring unit comprising circuitry for receiving the first transmitted processed received audio signal and for providing the first processed received audio signal to an audio signal network, to transmit the first processed received audio signal to devices coupled to the audio signal network.

16. A person monitoring system in accordance with claim 9, further comprising a second monitored unit comprising:

a second microphone for transducing second radiated sound waves and second sound waves emanating from a second person to a second received audio signal;

second circuitry for removing from the second received audio signal a portion of the second received audio signal corresponding to the second radiated sound waves to provide a second processed received audio signal corresponding to the second sound waves emanating from the second person; and second transmitting circuitry to transmit the second processed received audio signal.

17. A person monitoring system comprising:

a monitored unit comprising a first microphone for transducing radiated sound waves and sound waves emanating from the person to a received audio signal and circuitry for removing from the received audio signal a portion of the received audio signal corresponding to the radiated sound waves to provide a first processed received audio signal corresponding to the sound waves emanating from the person, the monitored unit further comprising transmitting circuitry to transmit the first processed received audio signal, the person monitoring system further comprising a second monitored unit comprising a second microphone for transducing second radiated sound waves and second sound waves emanating from a second person to a second received audio signal;

second circuitry for removing from the second received audio signal a portion of the second received audio signal corresponding to the second radiated sound waves to provide a second processed received audio signal corresponding to the second sound waves emanating from the second person; and second transmitting circuitry to transmit the second processed received audio signal, the person monitoring system further comprising a monitoring unit, the monitoring unit comprising receiving circuitry for receiving the first broadcast processed received audio signal and the second broadcast processed received audio signal; and circuitry for determining which of the first processed received audio signal and the second processed received audio signal to monitor.

18. A person monitoring system in accordance with claim 17, further comprising:

a second monitoring unit, the second monitoring unit comprising second receiving circuitry for receiving broadcast processed received audio signals; and second circuitry for determining which of the first processed received audio signal and the second processed received audio signal to monitor.

19. A person monitoring system comprising:

a monitored unit comprising a microphone for transducing radiated sound waves and sound waves emanating from the person to a received audio signal and circuitry for removing from the received audio signal a portion of the received audio signal corresponding to the radiated sound waves to provide a first processed received audio signal corresponding to the sound waves emanating from the person, the monitored unit further comprising transmitting circuitry to transmit the first processed received audio signal, the person monitoring system further comprising a first monitoring unit, comprising receiving circuitry for receiving the transmitted first processed received audio signal from the monitored unit; and determining circuitry to determine which of the first processed received audio signal and the second processed received audio signal to monitor, wherein the determining circuitry comprises circuitry for comparing the amplitude of the first processed received audio signal and the amplitude of the second processed received audio signal; and circuitry for selecting one of the first processed received audio signal and the second processed received audio signal corresponding to the processed received audio signal with the greater amplitude.

20. A method for operating a person monitoring system, comprising:

providing a source audio signal;

transducing the source audio signal to radiated sound waves, the transducing including radiating sound waves from a loudspeaker;

transducing sound waves including the radiated sound waves and sound waves emanating from a person to a received audio signal, the transducing including receiving the sound waves by a microphone; and removing a portion of the received audio signal corresponding to the radiated sound waves to provide a processed audio signal corresponding substantially to the sound waves emanating from the person.

21. A method in accordance with claim 20, wherein the transducing sound waves includes transducing sound waves from a noise source, and further comprising:

removing a portion of the received audio signal corresponding to the sound waves from the noise source.

22. A method in accordance with claim 21, wherein the removing a portion of the received audio signal corresponding to the sound waves from the noise source comprises filtering the received audio signal with an adaptive filter.

23. A method in accordance with claim 22, wherein filtering the received audio signal with an adaptive filter comprises:

transducing, separate from the transducing sound radiated sound waves, sound waves emanating from the person and sound waves from the noise source, by a microphone substantially closer to the noise source than to other sources of sound waves to provide transduced sound waves, and providing the transduced sound waves to the adaptive filter.

24. A method in accordance with claim 20, wherein the removing comprises band pass filtering the received audio signal.

25. A method in accordance with claim 24, wherein the band pass filtering comprises filtering the received audio signal with a filter with a pass band substantially corresponding with the speech audio band.

26. A method in accordance with claim 25, wherein the band pass filtering comprises filtering the received audio signal with a filter with break points of approximately 300 Hz and 3 kHz.

27. A method in accordance with claim 20, wherein the removing comprises filtering the received audio signal with an adaptive filter.

28. A method in accordance with claim 27, further comprising providing the source audio signal to the adaptive filter.

29. A method in accordance with claim 20, wherein the transducing the source audio signal comprises directionally radiating the sound waves so that a direction toward the microphone is a low radiation direction.

30. A method in accordance with claim 29, wherein the transducing the sound waves comprises directionally receiving the sound waves so that a direction from the loudspeaker is a low response direction.

31. A method in accordance with claim 30, wherein the directionally receiving the sound waves comprises:

a first receiving by a first substantially omni-directional microphone to provide a first omni-directionally received audio signal;

a second receiving by a second substantially omni-directional microphone to provide a second omni-directionally received audio signal;

adjusting the phase of the first omni-directionally received audio signal and the second omni-directionally received audio signal to provide phase-adjusted first and second received omni-directionally received audio signals; and combining the first and the second omni-directionally received audio signals.

32. A method in accordance with claim 29, wherein the directionally radiating the sound waves comprises:

low pass filtering the source audio signal to provide a low pass filtered audio signal;

high pass filtering the source audio signal to provide a high pass filtered audio signal;

a first combining of the high pass filtered audio signal and the low pass filtered audio signal to provide a first combined audio signal having a high frequency spectral band and a low frequency spectral band;

a differential second combining of the high pass filtered audio signal and the low pass audio signal to provide a second combined audio signal having a high frequency spectral band and a low frequency spectral band;

radiating the first combined audio signal and the second combined audio signal so that sound waves corresponding to the high frequency spectral band of the first combined audio signal high are radiated out of phase with the high frequency spectral band portion of the second combined audio signal.

33. A method in accordance with claim 29, wherein the source audio signal has a high frequency portion and a low frequency portion, the providing the source audio signal comprising:

providing a first track and a second track of the source audio signal wherein the first track and the second track each comprise a high frequency portion and a low frequency portion, wherein the providing the first track and the second track comprises processing the source audio signal high frequency portion so that high frequency portion of the first track high is out of phase with the high frequency portion of the second track.

34. A method in accordance with claim 20, further comprising transmitting the processed audio signal to a location remote from the person to provide a received processed audio signal.

35. A method in accordance with claim 34, further comprising transducing the received processed audio signal to sound waves corresponding to the received processed audio signal.

36. A method in accordance with claim 34, further comprising, in the absence of sound waves emanating from the person, transmitting an audio signal representing white noise.

37. A method in accordance with claim 20, wherein the receiving the sound waves by a microphone comprises receiving the sound waves by a microphone that is physically close to the person and wherein the microphone is physically distant from circuitry for performing the removing.

38. A method in accordance with claim 20, further comprising transmitting the processed audio signal to an audio network.

39. A method in accordance with claim 20, wherein the removing comprises:

radiating sound waves corresponding to an audio signal representing an audio test pattern;

transducing the sound waves corresponding to the audio signal representing the audio test pattern to a received audio test pattern audio signal; and comparing the received audio test pattern audio signal with the audio signal representing the audio test pattern to develop a transfer function representing the effect of the environment on the radiated sound waves corresponding to the audio signal representing the audio test pattern to a received audio test pattern audio signal.

40. A person monitoring system, comprising:

a first monitored unit for transducing to a first audio signal sound waves emanating from a first person and for transmitting the first audio signal;

a second monitored unit for transducing to a second audio signal sound waves emanating from a second person and for transmitting the second audio signal;

a monitoring unit for receiving the first audio signal and the second audio signal, the monitoring unit comprising circuitry for comparing the amplitude of the first audio signal and the amplitude of the second audio signal; and circuitry for selecting one of the first audio signal and the second audio signal corresponding to the audio signal with the greater amplitude.

41. A person monitoring system in accordance with claim 1, wherein the circuitry for removing from the received audio signal a portion of the received audio signal corresponding to the radiated sound waves to provide a first processed received audio signal corresponding to the sound waves emanating from the person comprises an adaptive filter.

42. A person monitoring system in accordance with claim 1, wherein the circuitry for removing from the received audio signal a portion of the received audio signal corresponding to the radiated sound waves to provide a first processed received audio signal corresponding to the sound waves emanating from the person further comprises a non-linear filter, operationally coupled to the adaptive filter.

43. A person monitoring system in accordance with claim 1, wherein the circuitry for removing from the received audio signal a portion of the received audio signal corresponding to the radiated sound waves to provide a first processed received audio signal corresponding to the sound waves emanating from the person further comprises a second adaptive filter.

44. A person monitoring system in accordance with claim 42, wherein the second adaptive filter is a predictive adaptive filter.

* * * * *